US009422032B2

(12) United States Patent
Bost et al.

(10) Patent No.: US 9,422,032 B2
(45) Date of Patent: Aug. 23, 2016

(54) LINE-LAYING OPERATIONS

(75) Inventors: Frederic Bost, Paris (FR); Charles Marc Antoine Donnet, Saint Maurice (FR); Xavier Bougro, Nanterre (FR); Lahoussine Aboutaj, Chatou (FR)

(73) Assignee: Acergy France SAS, Suresnes (FR)

( * ) Notice: Subject to any disclaimer, the term of this patent is extended or adjusted under 35 U.S.C. 154(b) by 227 days.

(21) Appl. No.: 13/824,260

(22) PCT Filed: Sep. 15, 2011

(86) PCT No.: PCT/IB2011/002574
§ 371 (c)(1),
(2), (4) Date: May 20, 2013

(87) PCT Pub. No.: WO2012/035432
PCT Pub. Date: Mar. 22, 2012

(65) Prior Publication Data

US 2013/0230356 A1 Sep. 5, 2013

(30) Foreign Application Priority Data

Sep. 17, 2010 (GB) ..... 1015594.3

(51) Int. Cl.
*F16L 1/12* (2006.01)
*B63B 21/04* (2006.01)
*B63B 35/04* (2006.01)

(52) U.S. Cl.
CPC ..... *B63B 21/04* (2013.01); *B63B 35/04* (2013.01)

(58) Field of Classification Search
CPC .. B63B 2021/003; B63B 21/04; B63B 21/08; B63B 21/50; B63B 21/16; F16L 3/01; F16L 3/012; F16L 3/015
USPC ..... 405/158, 159, 166, 167, 172, 169, 170, 405/223.1, 224, 224.1
See application file for complete search history.

(56) References Cited

U.S. PATENT DOCUMENTS

| | | | | |
|---|---|---|---|---|
| 3,685,305 | A | 8/1972 | Lloyd, III | |
| 2010/0024706 | A1 * | 2/2010 | Foo et al. | 114/264 |

FOREIGN PATENT DOCUMENTS

| | | |
|---|---|---|
| DE | 1 041 126 | 10/1958 |
| GB | 1081268 | 8/1967 |
| GB | 1 540 650 | 2/1979 |
| GB | 2 439 295 | 12/2007 |
| WO | WO 2004/085898 | 10/2004 |
| WO | WO 2006/085739 | 8/2006 |
| WO | WO 2008/129320 | 10/2008 |

* cited by examiner

*Primary Examiner* — Frederick L Lagman
*Assistant Examiner* — Patrick Lambe
(74) *Attorney, Agent, or Firm* — Levy & Grandinetti

(57) ABSTRACT

A line-handling apparatus for use in assembling a line being deployed from a vessel is disclosed. The line includes at least two sections of, for example, chain and wire in longitudinal sequence. A hang-off carriage has at least one line support adapted to support the line. The line support is capable of supporting a length of line hanging from the carriage via that support. The carriage is movable around a horizontal area located beneath separate line deployment locations on the vessel spaced horizontally from each other, to align the line support with each line deployment location, and to move the supported length of line between the line deployment locations for connection of subsequent sections of the line.

36 Claims, 20 Drawing Sheets

LINE-LAYING OPERATIONS

This Application is the U.S. National Phase of International Application Number PCT/IB2011/002574 filed on Sep. 15, 2011, which claims priority to Great Britain Application No. 1015594.3 filed on Sep. 17, 2010.

This invention relates to techniques for laying lines and for making connections between sequential lengths of line in offshore line-laying operations. The invention is particularly concerned with making connections between lengths of chain and lengths of wire in the installation of mooring lines for FPSOs and the like. However, the principles of the invention may have wider application in the offshore industry and the sequential lengths of line are not necessarily of different line types.

FPSOs and the like are typically moored on site for many years. The FPSO is held in place with a mooring system comprising several legs radiating from the FPSO. Each leg of the mooring system is defined by at least one mooring line terminating in an anchor such as a suction pile embedded in the seabed.

Anchors and mooring lines are typically pre-installed up to three months before the arrival of the FPSO, to allow for issues such as soil settlement. The mooring lines are deployed from an installation vessel, attached to the anchors and then abandoned on the seabed until being recovered when they are required to moor the FPSO. The mooring lines are recovered, transferred to and secured to the FPSO upon its arrival on site.

Each mooring line comprises, in sequence from bottom to top, a bottom or ground chain attached to the anchor, a section of wire (typically spiral strand wire or SSW) attached to the ground chain, and a top chain attached to the wire section. Various connectors make the necessary connections between these line sections.

The wire section constitutes most of the length of the mooring line, as—for a given tensile strength—wire is lighter, more compact to store and less expensive than chain. Chains are used instead of wire at the bottom and top of the mooring line to avoid damage to the wire at those vulnerable locations.

Mooring lines are typically installed by service vessels such as lay barges. Such vessels are equipped with various cranes and winches for performing subsea operations including line laying and pipe laying. As such vessels are expensive assets that are much in demand around the world, there is commercial pressure to reduce the time that they need to spend on site performing operations such as laying mooring lines.

The bottom chain, wire section and top chain must be deployed in sequence to create the mooring line and connectors must be placed between each of those parts of the mooring line. The wire is typically deployed from a drum of a deployment winch on the installation vessel. The chain is typically deployed from a gypsy wheel. The gypsy wheel may be driven by the same deployment winch as the drum but the deployment axes of the gypsy wheel and drum will be horizontally separate, for example spaced fore-and-aft with respect to the hull of the vessel.

The mooring line constitutes a heavy load that, in existing arrangements, necessitates using a main crane of the installation vessel. Existing methods for installing mooring lines employ a fixed outrigger at which connections between the line sections are made. They involve extensive use of the main crane to transfer the load repeatedly between the deployment axes of the wire drum and the gypsy wheel and the outrigger. ROV disconnection is required. Existing methods also involve considerable manhandling of moving loads.

The main crane of the installation vessel is in much demand for other operations such as overboarding suction piles. Hence, main crane activities tend to lie on the critical path of a mooring line installation operation. This reduces productivity and increases the length of time that the installation vessel needs to remain on site.

Use of the main crane also adds to the safety risks of manhandling, and introduces technical risks associated with heavy lifting in a confined and congested area.

Existing techniques for installing mooring lines also involve a risk of damaging the wire section by creating loops or bends in the wire or by damaging its protective coating. The wire is strong in tension but is fragile when subjected to cross-axis loads, bending and abrasion.

It is against this background that the present invention has been made. From one aspect, the invention resides in a line-handling apparatus for use in assembling a line being deployed from a vessel, that line comprising at least two sections in longitudinal sequence, wherein the apparatus comprises a hang-off carriage having at least one line support adapted to support the line, the line support being capable of supporting a length of line hanging from the carriage via that support, the carriage being movable around a horizontal area located beneath separate line deployment locations on the vessel spaced horizontally from each other, to align the line support with each line deployment location, and to move the supported length of line between the line deployment locations for connection of subsequent sections of the line.

Thus, the invention eases and simplifies the connection between sequential parts of the mooring lines. It does so by hanging the load deployed (for example, the bottom chain) and transferring the load below the next connection point (for example, the wire spooled on the drum of the deployment winch). The load is hung from a platform equipped with a chain stopper and a socket clamp sliding on rails underneath the deployment winch.

The invention provides a movable hang-off structure whose movement may be automated or semi-automated. The hang-off structure is used for the connection and disconnection of large diameter, heavy chains to wire sockets during various phases of mooring line deployment.

The moving hang-off structure of the invention allows parallel activity with the main crane and so reduces main crane lifting operations as much as possible to optimise operational time. Indeed, it is possible to reduce lifting operations by the main crane in a ratio of 1 to 5. To create a typical FPSO mooring system comprising sixteen mooring lines, only sixteen main crane handling operations will be required, excluding overboarding the suction piles. This compares with eighty such operations when using a standard fixed outrigger structure. Thus, main crane activities feature less on the critical path, shortening the deployment operation. It is anticipated that for a typical FPSO mooring deployment operation lasting circa forty days, 8-10% of the installation vessel time may be saved. This greatly increases the productivity of the vessel and its crew.

The invention also improves safety, by removing the requirement to manhandle moving loads during chain-to-wire connection operations. It overcomes technical problems of heavy lifting in a confined and congested area. It frees deck space on the installation vessel. It provides safe and easy access to manipulate heavy items such as H-link connectors and other subsea connector elements. It also reduces the risk of damage to the wire by holding and transferring the wire gently without imparting significant cross-axis loads or exposing the wire to abrasion.

The horizontal area in which the carriage is movable may extend beyond at least one of the deployment locations, for example to within the working radius of a crane for loading a connector element onto the line support.

Preferably, at least one of the line sections is a wire and the carriage has a wire support adapted to support the wire. It is also possible for at least one of the line sections to be a chain and for the carriage to have a chain support adapted to support the chain. In a preferred embodiment of the invention to be described below, the line comprises at least one section of chain in longitudinal sequence with at least one section of wire and the carriage comprises: a chain support adapted to support the chain; and a wire support adapted to support the wire; and the line deployment locations are chain and wire deployment locations, the carriage being movable to align the chain support with the chain deployment location and the wire support with the wire deployment location, and to move the supported length of line between said deployment locations for connection of subsequent sections of the line.

Advantageously, the line support is adapted to support a connector element that is attached or attachable to a line section. In this way, the carriage can be used to transport a connector element; the carriage can also be used to suspend a line section, such as a wire, from a connector element without touching the line of that section itself. For this purpose, the line support suitably comprises a socket that narrows downwardly, and preferably comprises formations that are shaped to complement different connector elements.

Conveniently, the carriage is mounted to an outrigger platform that is movable along the hull of the vessel. That platform is suitably mounted to the vessel by at least one rail extending generally horizontally along the hull. If the carriage is movable inboard and outboard relative to the platform, this allows the carriage to be moved in two dimensions relative to the hull.

The platform preferably defines a slot for accommodating hanging chain or wire, that slot extending in an outboard direction and being open to its outboard end. In that case, the carriage suitably defines a gap aligned with the slot of the platform. For example, the carriage may comprise a chassis having spaced arms that define the gap between them: the chassis may be generally U-shaped, having generally parallel arms joined by a cross-member. The carriage preferably also comprises a gate member on its outboard side that closes the gap and that can be opened to abandon the line.

The line support advantageously comprises portions that are separable to allow the line to be deployed. For example, the carriage may comprise a platen that carries the line support, the platen being separable into jaws that divide the line support. In that case, a junction between the jaws suitably extends along the gap in the chassis.

In the preferred embodiment described below, at least one line support is a chain support comprising a collar for surrounding a chain, which collar supports chain-engaging members that are co-operable to embrace and engage the chain. The chain-engaging members preferably cooperate to define a plate that is supported on top of the collar, and preferably have chain-engaging formations shaped to engage successive links of the chain. Advantageously, the collar is pivotable about the longitudinal axis of the chain to align the chain-engaging formations with the links of the chain. Where the chain support comprises portions that are separable, those portions suitably include portions of the collar and respective chain-engaging members attached to each portion of the collar.

More generally, the apparatus preferably has at least two line supports adapted to support different types of line. Those line supports are preferably disposed one outboard and one inboard of each other.

The inventive concept also embraces a line-handling method for use in assembling a line being deployed from a vessel, that line comprising at least two sections in longitudinal sequence, wherein the method comprises supporting the line to hang from a carriage movable around a horizontal area located beneath deployment locations on the vessel spaced horizontally from each other, and moving the carriage to bring the line into alignment with a deployment location for connection of subsequent sections of the line.

Where the line comprises at least one section of chain in longitudinal sequence with at least one section of wire, the method suitably comprises moving a supported length of the chain into alignment with a wire deployment location, and/or moving a supported length of the wire into alignment with a chain deployment location.

Part of the carriage may be divided to provide clearance for deployment of the chain or wire without moving the carriage, and the line may be abandoned from the carriage in an outboard direction, optionally after opening part of the carriage to permit said abandonment.

The inventive concept extends to a vessel fitted with the line-handling apparatus of the invention or operating in accordance with the method of the invention.

In order that the invention may be more readily understood, reference will now be made, by way of example, to the accompanying drawings in which:

FIG. 1 is a layout diagram of a site for a FPSO that has yet to be positioned, showing pre-installed mooring piles and lines for the FPSO;

FIG. 2*a* is a side view of a mooring line extending from the now-positioned FPSO to a suction pile, with FIG. 2*b* being an enlarged detailed view of the ground chain end of the mooring line and the pile;

Figure 26A:
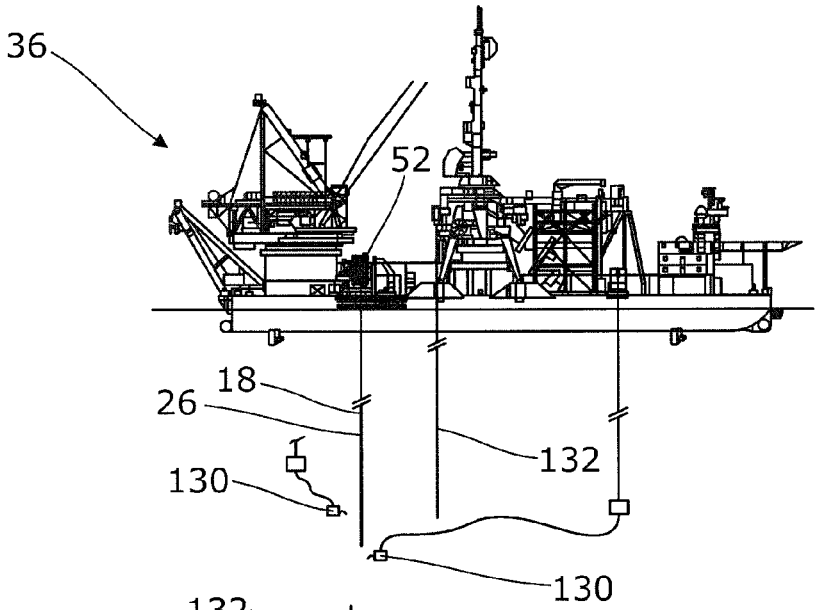
Figure 26A:
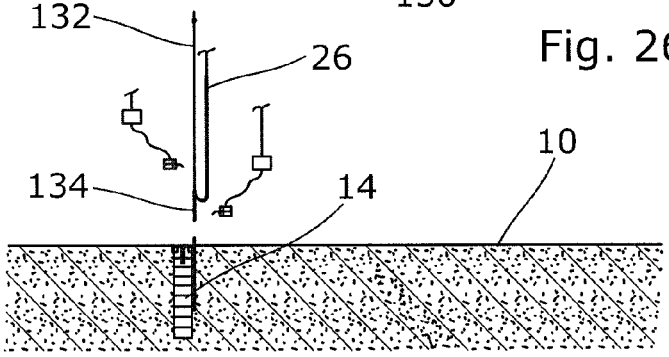
Figure 26B:
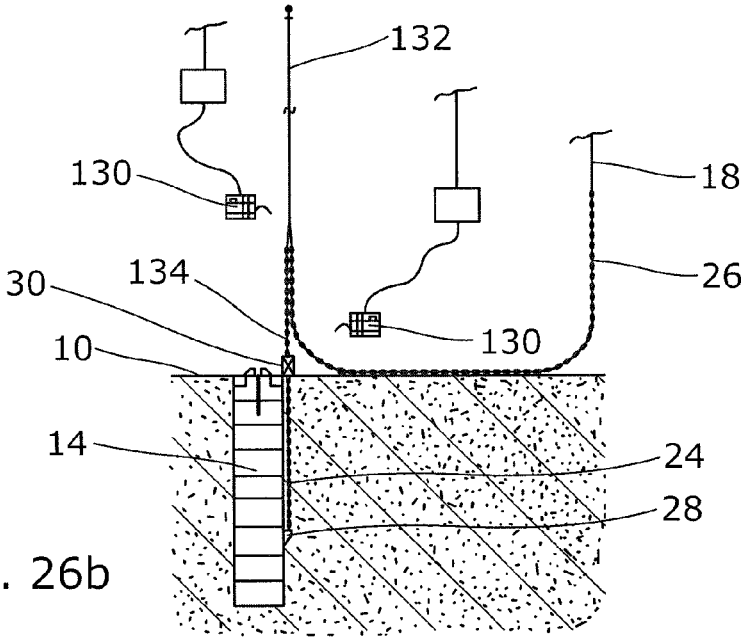
Figure 27:
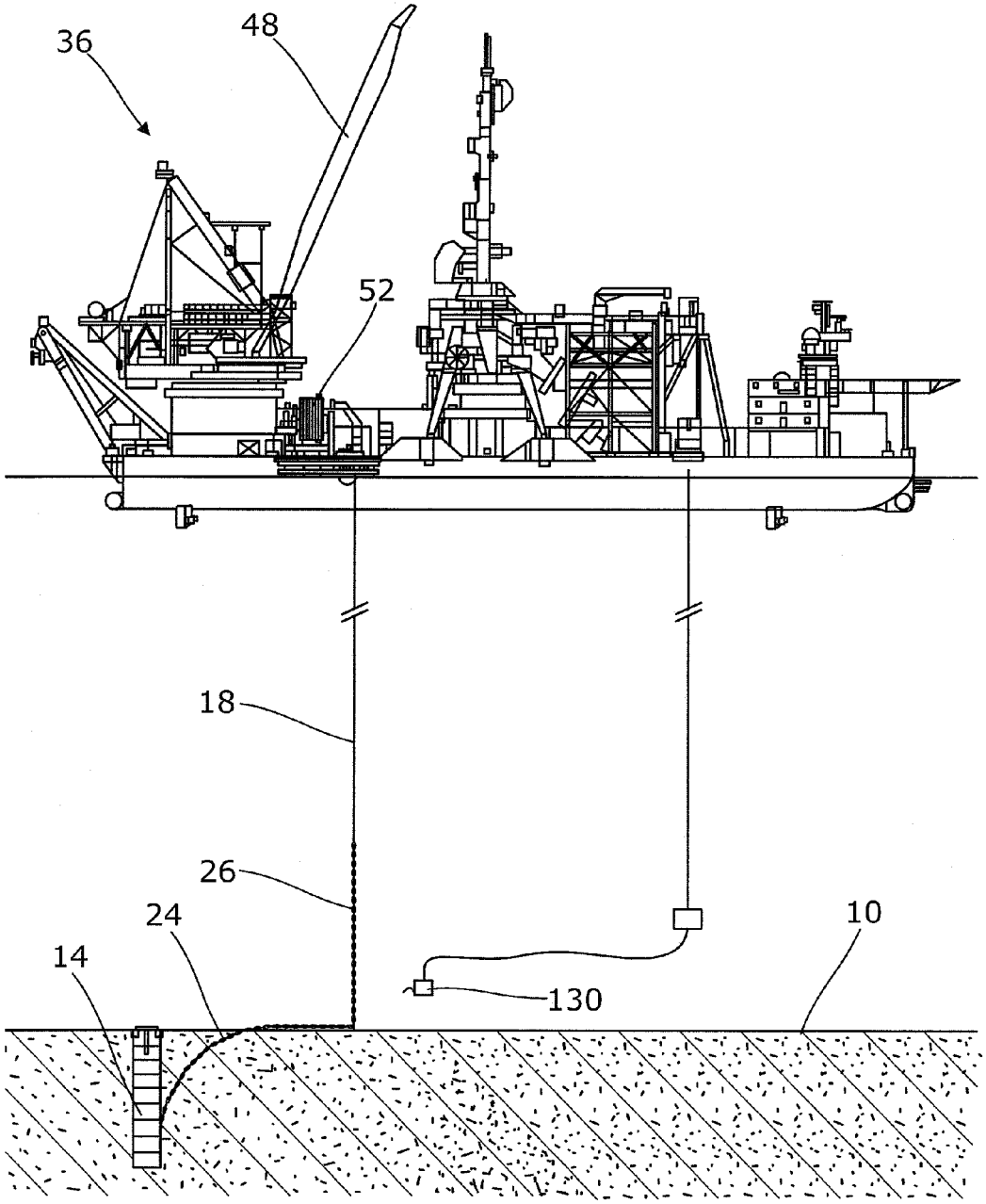
Figure 28:
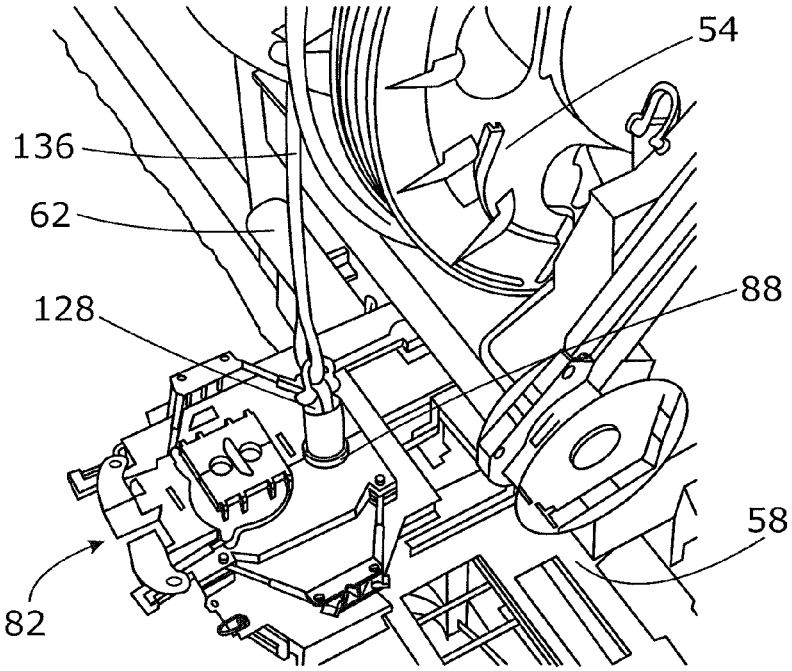
Figure 29:
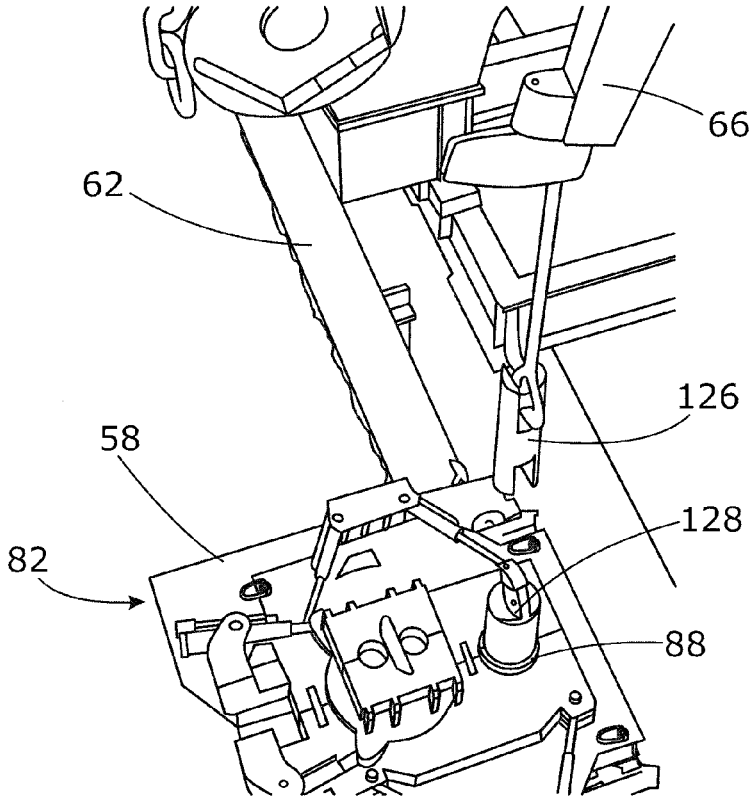
Figure 30:
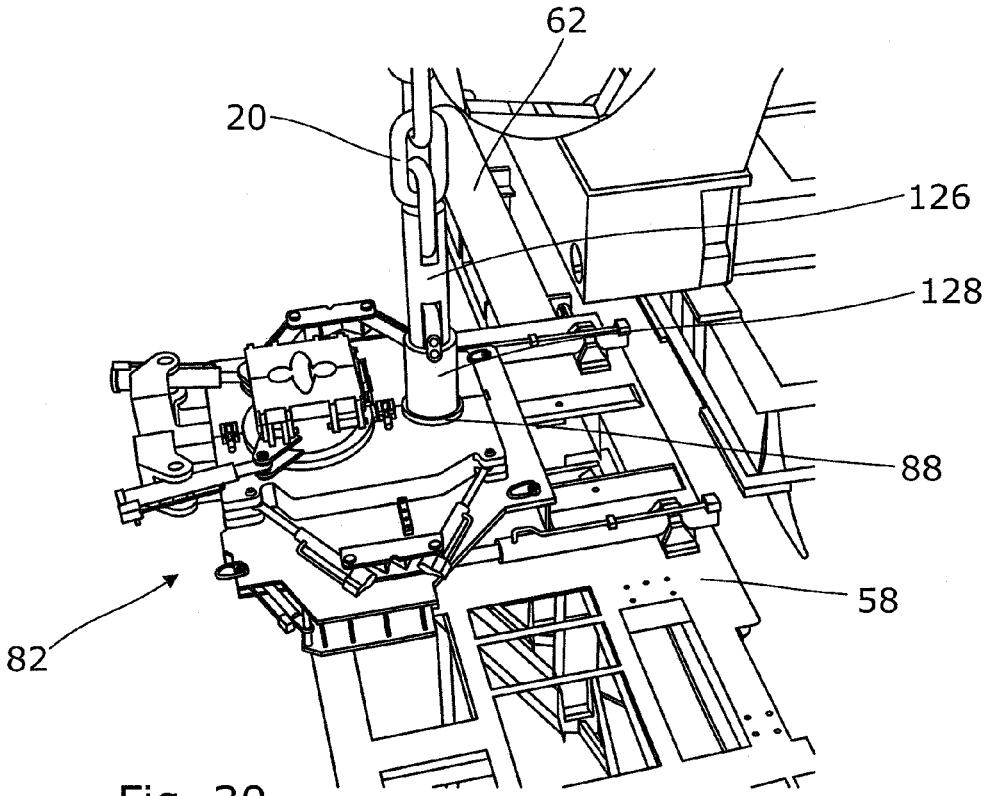
Figure 31:
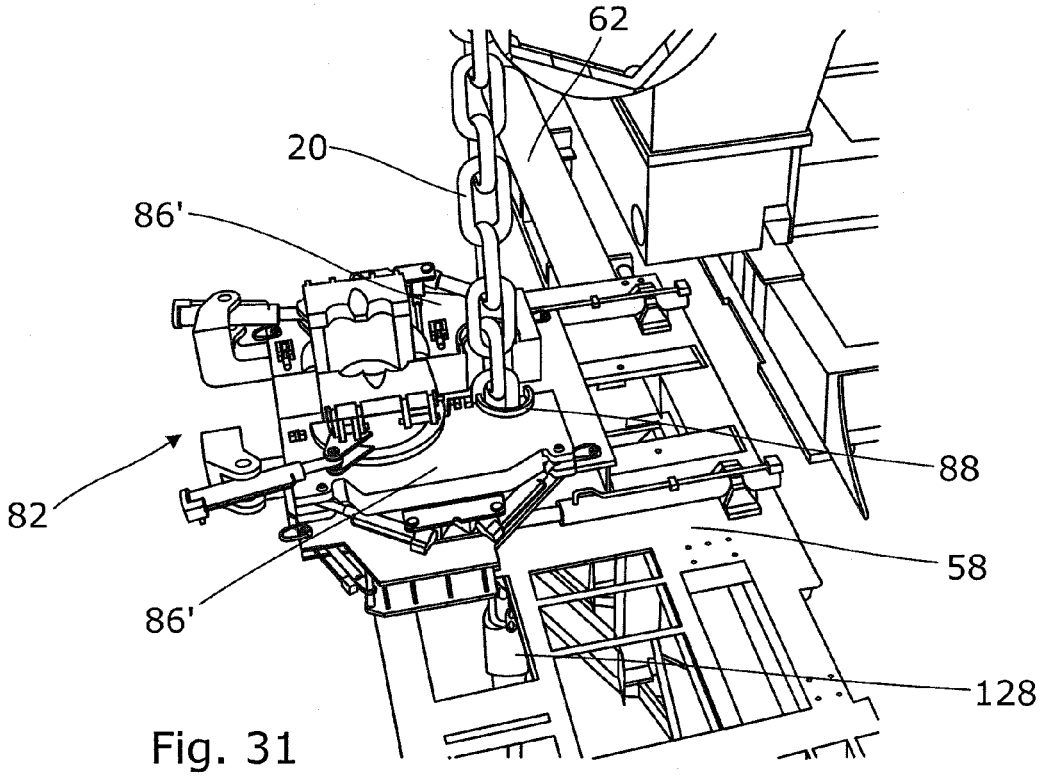
Figure 32:
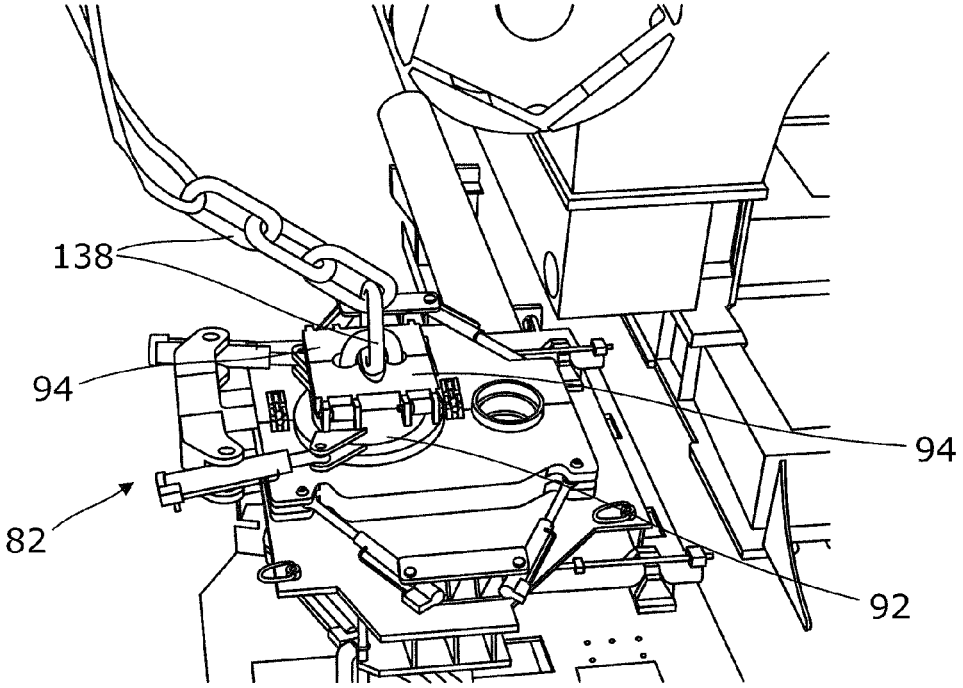
Figure 33:
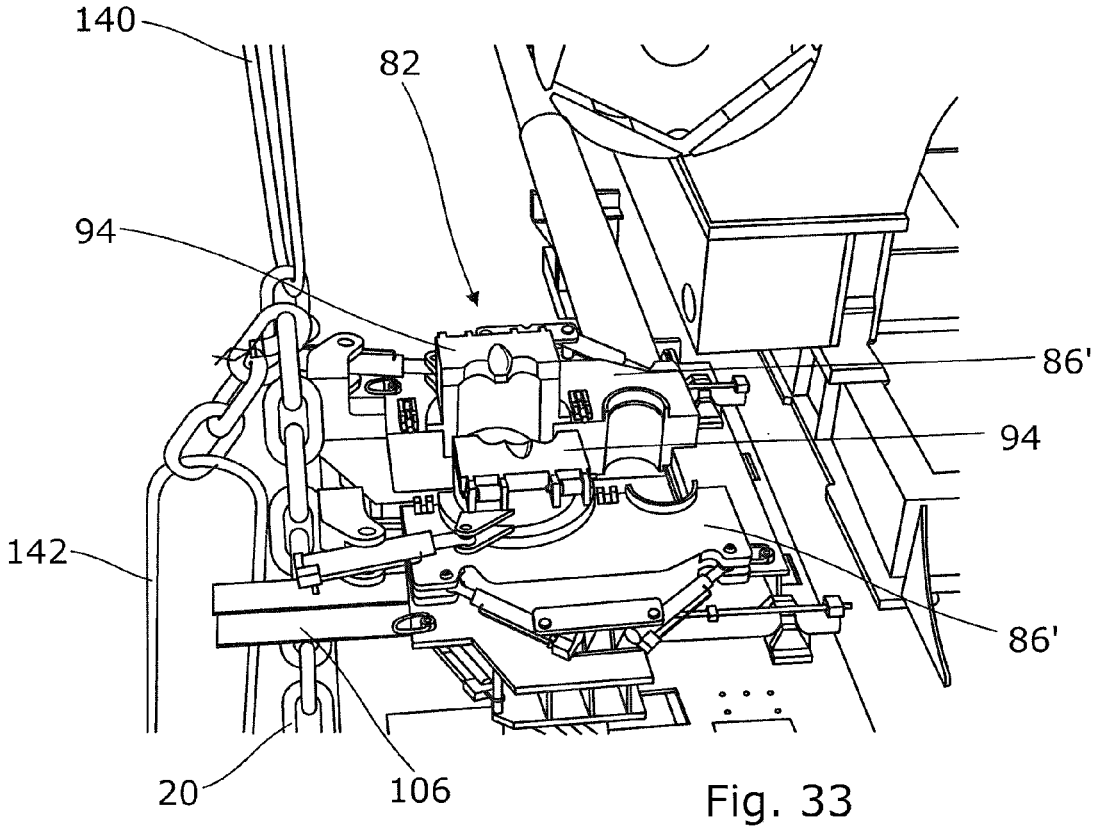
Figure 34A:
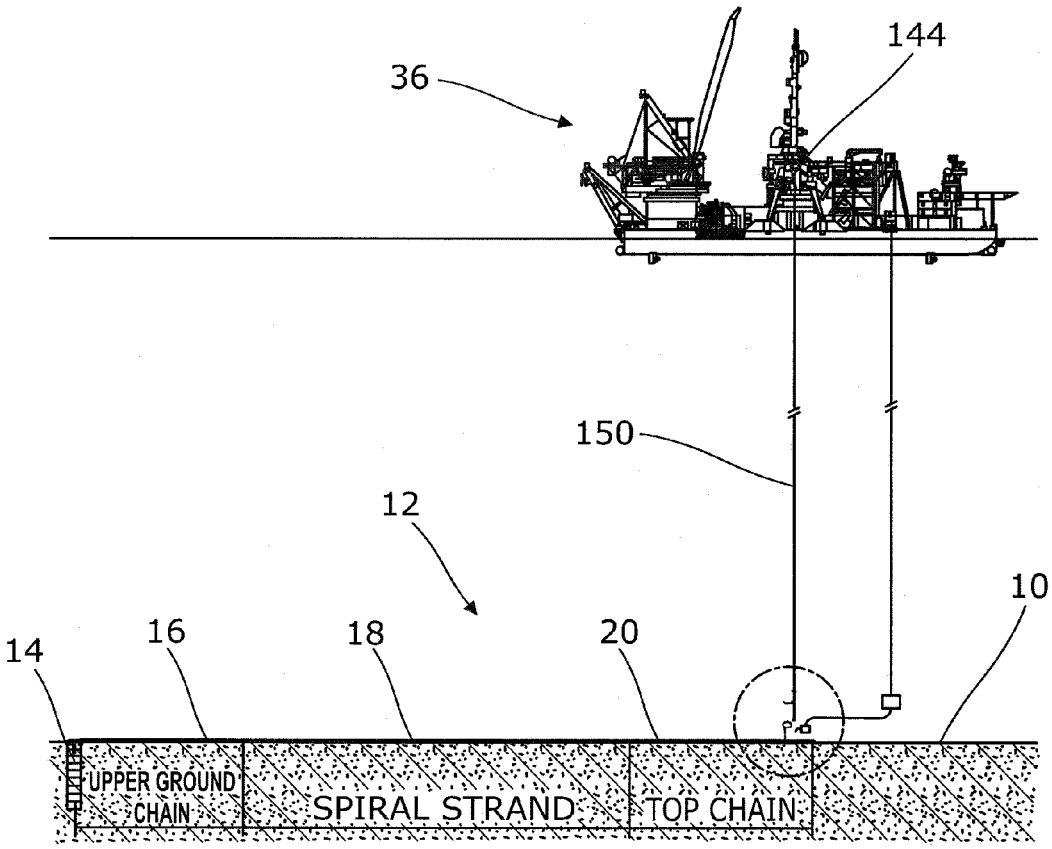
Figure 34B:
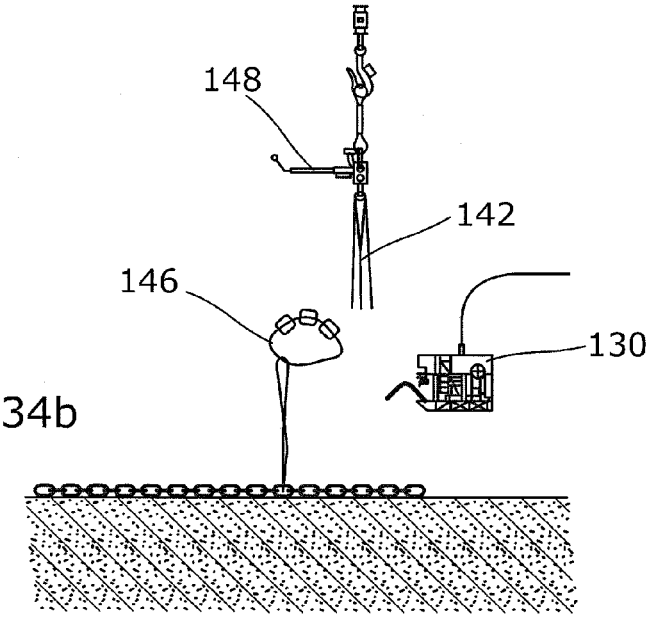

FIG. 26*a* is a side view of the lay barge deploying the upper section of ground chain in readiness for subsea connection to the lower section of ground chain, with FIG. 26*b* being an enlarged detailed view of the connection operation itself;

FIG. 27 is a side view of a spiral strand wire laying operation;

FIG. 28 is a perspective view of the carriage halves closed again to support a connector element at the upper end of the spiral strand wire in the connector socket of the carriage;

FIG. 29 is a perspective view of a connector element being attached to the upper end of the spiral strand wire;

FIG. 30 is a perspective view of the top chain being attached to the connector element at the upper end of the spiral strand wire;

FIG. 31 is a perspective view of the carriage halves separated to free the connector and the top chain for deployment;

FIG. 32 is a perspective view of the carriage halves closed again to seat the upper end of the top chain in the closed jaws of the carriage;

FIG. 33 is a perspective view of the carriage halves separated to free the top chain for abandonment by outboard movement through the open-ended slot of the hang-off platform; and FIG. 34*a* is a side view of completion of the abandonment operation, with FIG. 34*b* being an enlarged detailed view of the top chain end of the mooring line.

Figure 1:
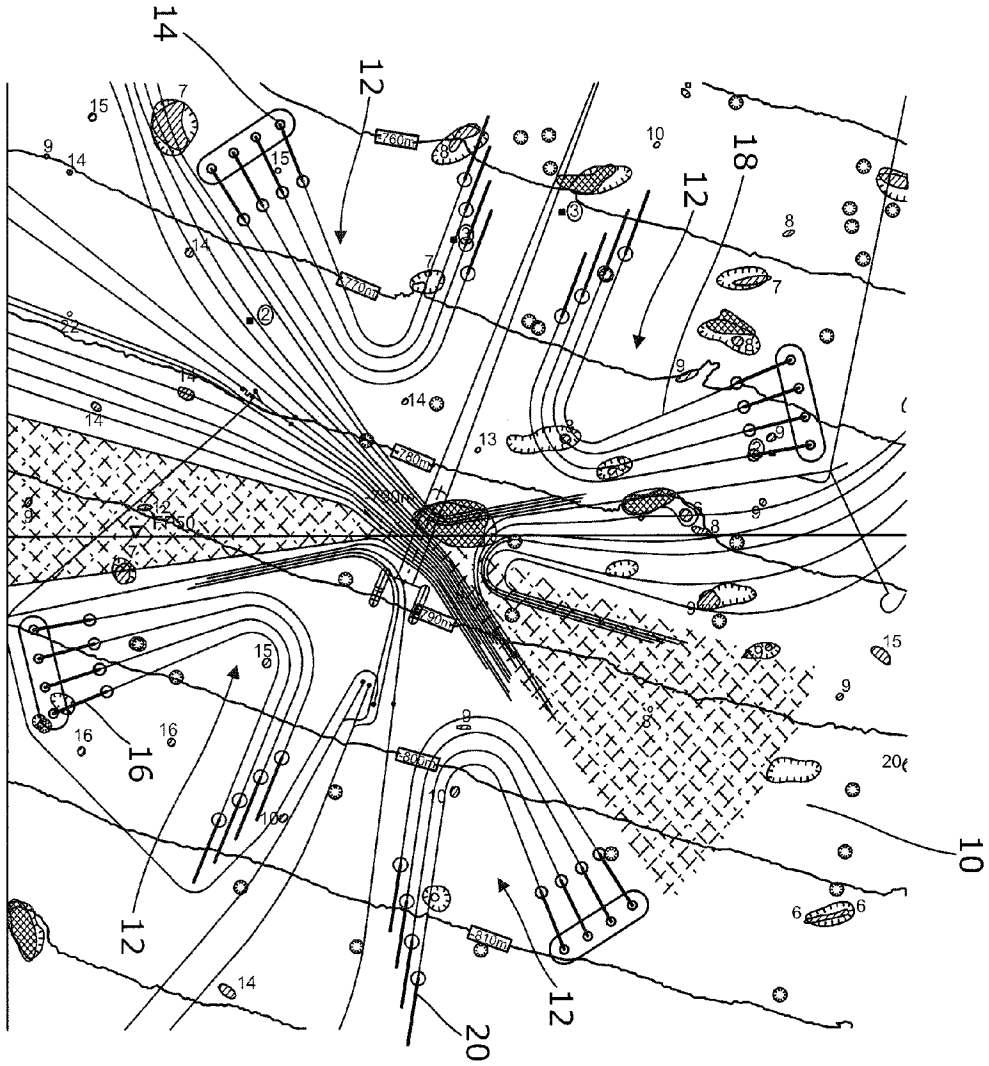

Referring firstly to FIG. 1 of the drawings, this shows the layout of the seabed 10 around a site for a Floating Production Storage and Offloading vessel (FPSO). Seabed contour lines and other details of the site are shown. The FPSO has yet to be positioned and so is not shown in FIG. 1.

The FPSO will be held in place with a passive spread mooring system comprising sixteen semi-taut legs arranged in a 4×4 spread-type pattern. In other words, the FPSO will be moored with a total of sixteen mooring lines 12 in four groups of four, one group at each corner of the FPSO. Each mooring line 12 is anchored by a respective suction pile 14 embedded in the seabed 10. A mooring line 12 and the associated suction pile 14 together define one leg of the mooring system. The suction piles 14 may be pre-installed some time before attachment of the mooring lines 12 or may be installed during installation of the mooring lines 12.

Each mooring line 12 comprises, in sequence from bottom to top, a bottom or ground chain 16 attached to the associated suction pile 14, a length of spiral strand wire (SSW) 18 attached to the ground chain 16 that constitutes most of the length of the mooring line 12, and a top chain 20 attached to the SSW section 18. Different connectors such as H-Links, a twisted H-Link, Y-links and Balltec subsea connectors make the connection between different line components as will be explained. Balltec subsea connectors are supplied by Balltec Ltd of Lancashire, UK and have ball-and-roller engagement mechanisms.

The SSW 18 will generally be of coated steel but recent developments suggest that it may be possible to use a synthetic plastics material: references to 'wire' in this specification are not intended to limit the meaning only to wires of metallic materials.

The suction piles 14 and mooring lines 12 are typically pre-installed up to three months before the arrival of the FPSO. The mooring lines 12 are deployed from an installation vessel, attached to the suction piles 14 and then abandoned on the seabed 10 until being recovered when they are required to moor the FPSO. As can be seen in FIG. 1, the mooring lines 12 of each group are laid in a generally parallel arrangement with their SSW sections 16 curved while observing a minimum permissible bend radius. The mooring lines 12 will be recovered and transferred to the FPSO upon its arrival, whereupon their top chains 20 will be secured to the FPSO as now shown in FIG. 2*a*.

Figure 2A:
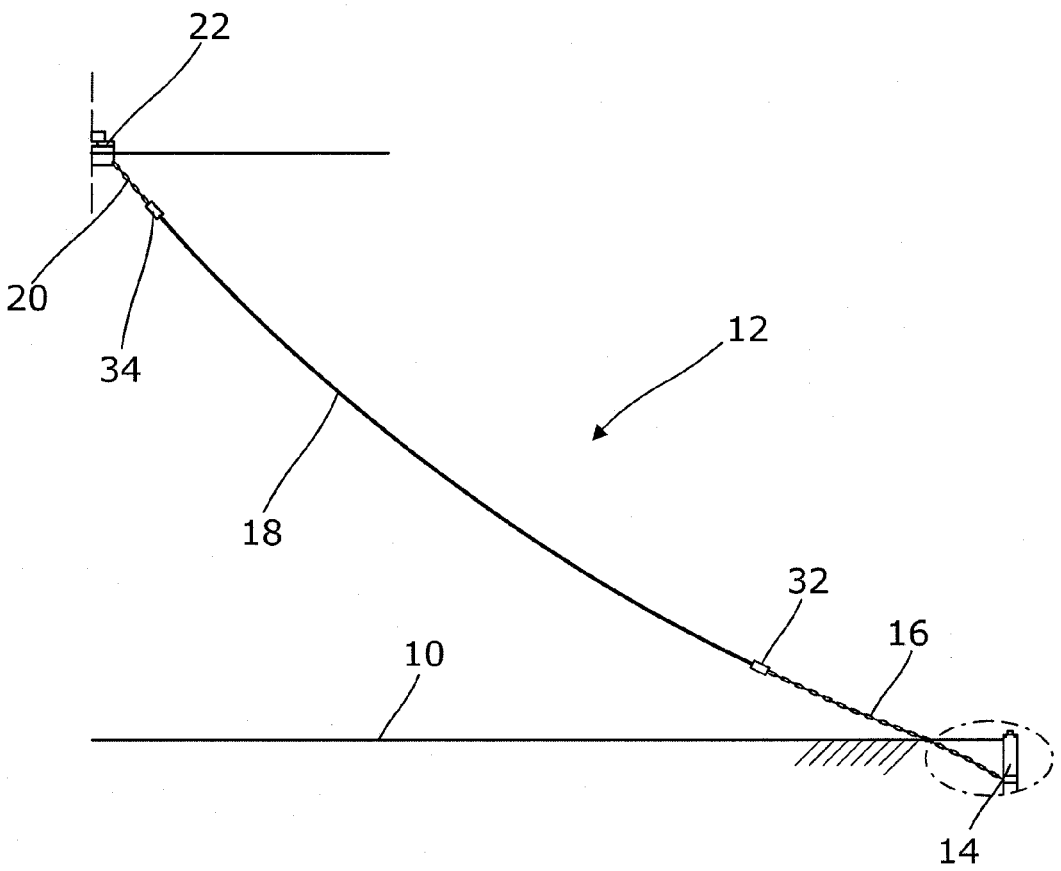
Figure 2B:
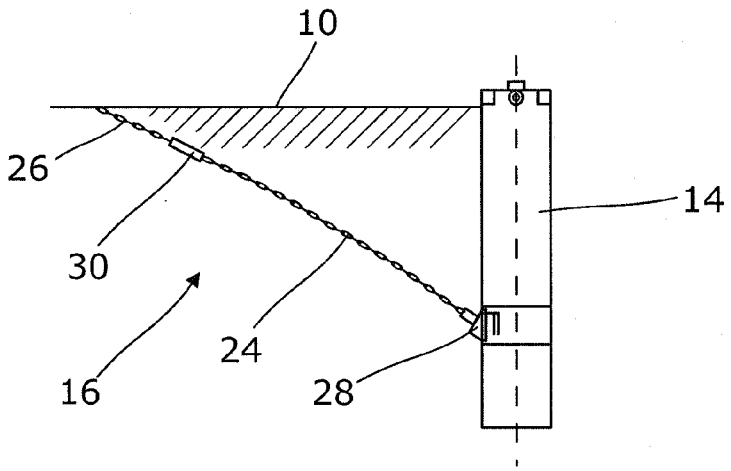

Moving on then to FIGS. 2*a* and 2*b*, these show one of the mooring lines 12 having been recovered and now in use mooring an FPSO 22. It will be apparent from the detail view of FIG. 2*b* that each ground chain 16 is in two sections, namely a lower section 24 and an upper section 26. In sequence from the bottom to the top of the mooring line 12:

- the lower section 24 of the ground chain 16 is connected to a buried lower side wall of the suction pile 14 by a twisted H-Link connector 28;
- the upper section 26 of the ground chain 16 is connected to the lower section 24 of the ground chain 16 by a Balltec subsea connector 30, with a female receptacle element of the subsea connector 30 being connected to the lower section 24 by a Y-link and a cooperating male element of the subsea connector 30 being connected to the upper section 26 by a further Y-link;
- the SSW 18 is connected to the upper section 26 of the ground chain 16 by a H-link connector 32; and
- the top chain 20 is connected to the SSW 18 by a H-link connector 34.

As will be described more fully later, the lower section 24 of the ground chain 16 is attached to the associated suction pile 14 before the suction pile 14 is overboarded and lowered to penetrate the seabed 10. When the FPSO is moored, the lower section 24 of the ground chain 16 and the connector 30 are buried under the seabed 10 and the upper section 26 of the ground chain 16 extends from there above the seabed 10 to the SSW 18 via connector 32.

In a non-limiting example: the length of the top chain 20 is between 165 m and 200 m; the lower section 24 of the ground chain 16 is 23 m long; the upper section 26 of the ground chain 16 is 182 m long; and the SSW section 18 is 1285 m long.

Referring now to FIGS. 3 to 7 of the drawings, these give an overview of a lay barge 36 exemplified here by the applicant's vessel Acergy Polaris. Among many other capabilities, the lay barge 36 is adapted in accordance with the invention to lay mooring lines 12.

Figure 3:
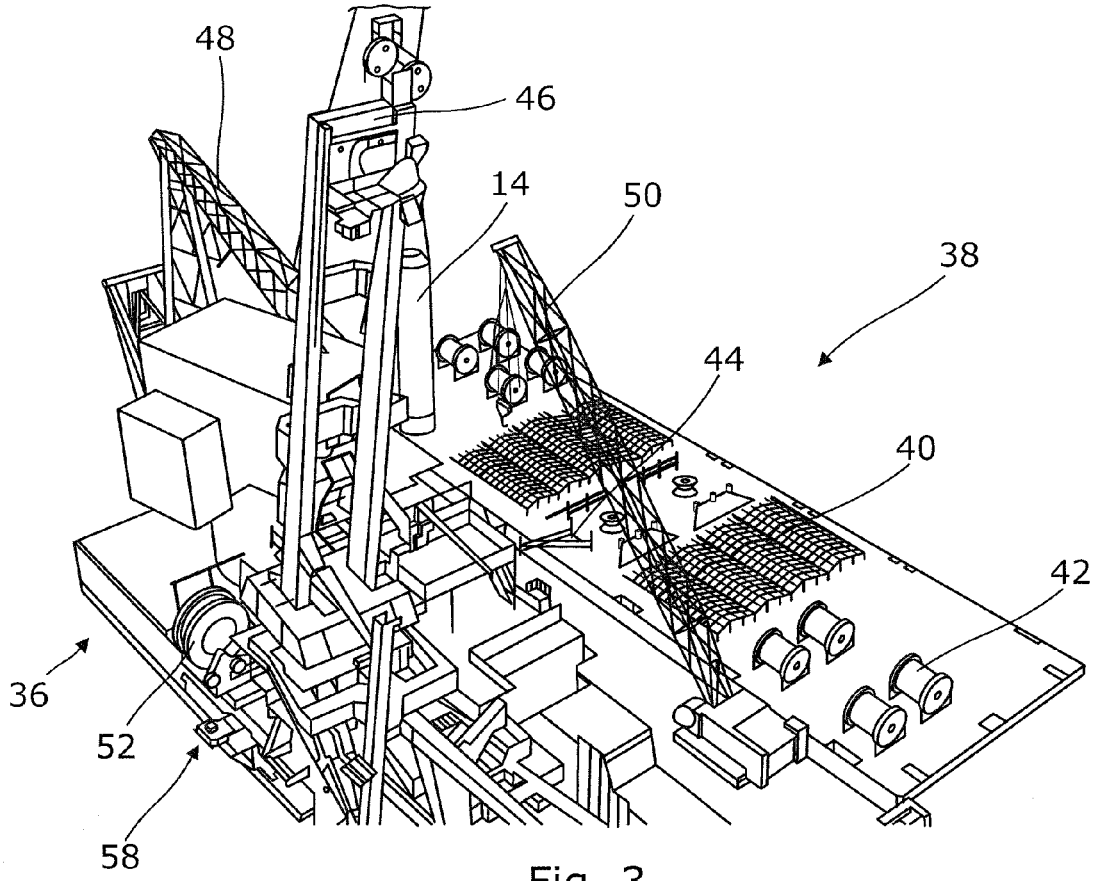
FIG. 3 is a perspective view of a lay barge with a cargo barge alongside.
Figure 4:
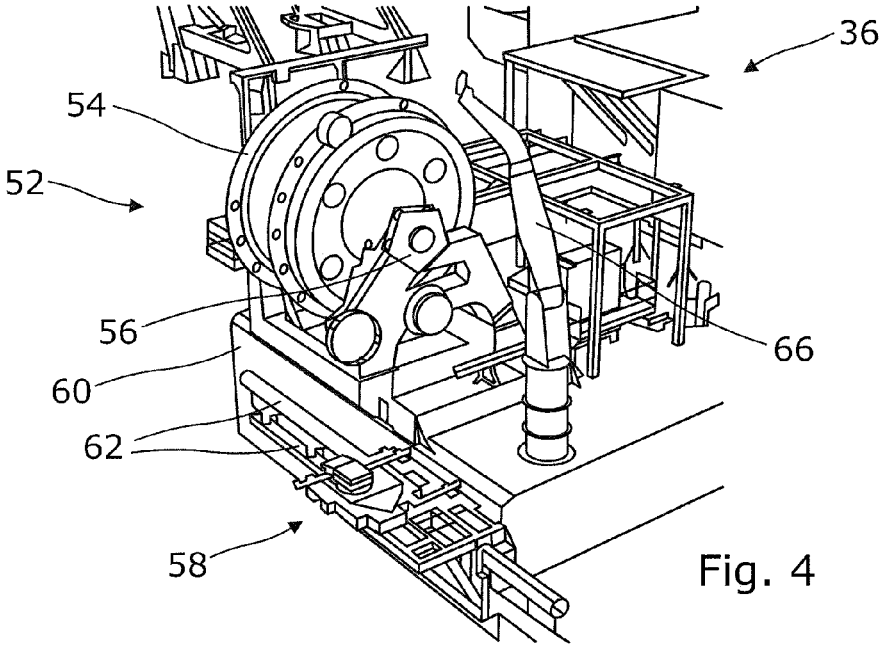
FIG. 4 is an enlarged perspective view showing a detail of the lay barge shown in FIG. 3, including a hang-off platform in accordance with the invention.

The lay barge 36 is shown in FIG. 3 with a cargo barge 38 tied alongside to supply and provide temporary storage for supplies including baskets 40 of chain 16, 20, reels 42 of SSW 18 and suction piles 14. An offloading chute 44 extending outboard from the port side of the lay barge 36 lies on the deck of the cargo barge 38 to facilitate transfer of chain 16, 20 from the cargo barge 38 to the lay barge 36 as required.

As FIG. 3 also shows, the lay barge 36 comprises a J-lay tower 46. The J-lay tower 46 is not relevant to the present invention and so will not be discussed further, but an abandonment and recovery (A&R) winch associated with the J-lay function may be used by the invention as will be described. The lay barge 36 further comprises a Clyde-type main crane 48. The main crane 48 is used in certain major lifting operations in accordance with the invention, such as overboarding the suction piles 14. However, by virtue of the invention, use of the main crane 48 is advantageously minimised. An auxiliary crane 50 on the lay barge 36 is used to transfer loads such as reels 42 from the cargo barge 38 to the lay barge 36.

As best shown in FIGS. 4 to 7, the lay barge 36 further comprises deployment apparatus for deploying mooring lines 12, which apparatus is largely disposed on the starboard side of the lay barge 36 directly opposite the offloading chute 44. The deployment apparatus comprises a deployment winch 52 having a drum 54 for deployment of wire and a gypsy wheel 56 for deployment of chain. The deployment winch 52 will typically have a capacity of 150 tonnes.

The invention adds a sliding hang-off platform (SHOP) 58 disposed generally beneath the deployment winch 52, outboard of the hull 60 of the lay barge 36. The hang-off platform 58 slides longitudinally on parallel upper and lower rails 62 attached to the outer side of the hull 60, extending fore-and-aft. Those rails 62 and the overall structure of the hang-off platform 58 are best appreciated in the detail views of FIGS. 8 and 9. In principle, the platform 58 is an automatic outrigger able to move the load below the deployment winch 52 where that load needs to be connected, thus avoiding using the crane 48 for connecting the mooring leg parts. Details of the platform 58 will be described after this continued overview of the deployment apparatus with reference to FIGS. 5 to 7.

Figure 5:
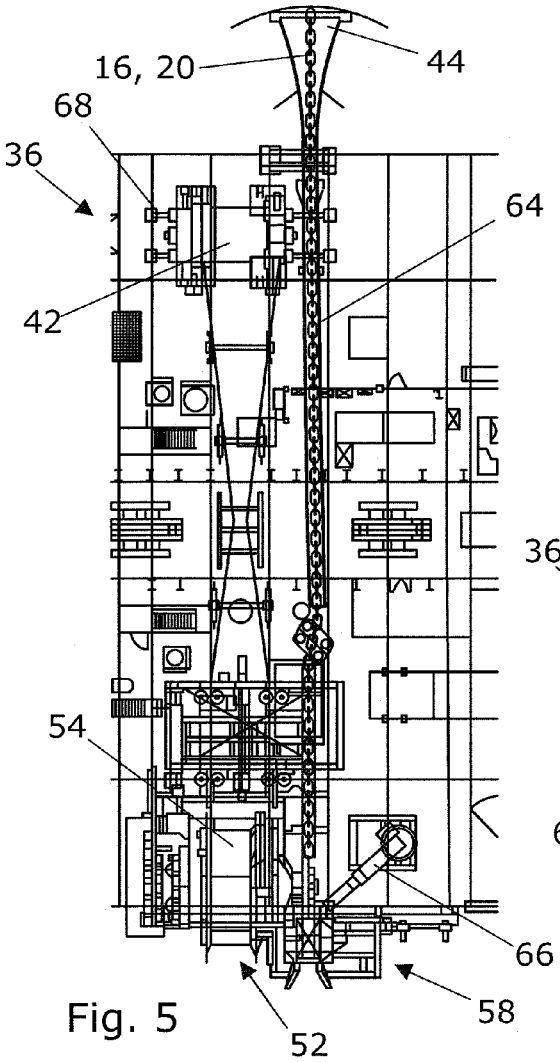
FIG. 5 is a partial plan view of the lay barge of FIG. 3 as chain is deployed.

FIG. 5 shows the chain 16, 20 from the cargo barge 38 sliding inboard onto the port side of the lay barge 36 over the chute 44. The end of the chain 16, 20 has been pulled from there to the starboard side of the lay barge 36 along gutters 64 extending across the lay barge 36. There, the chain 16, 20 has been engaged with the gypsy wheel 56 of the deployment winch 52 for deployment into the sea over the starboard side of the lay barge 36.

Figure 6:
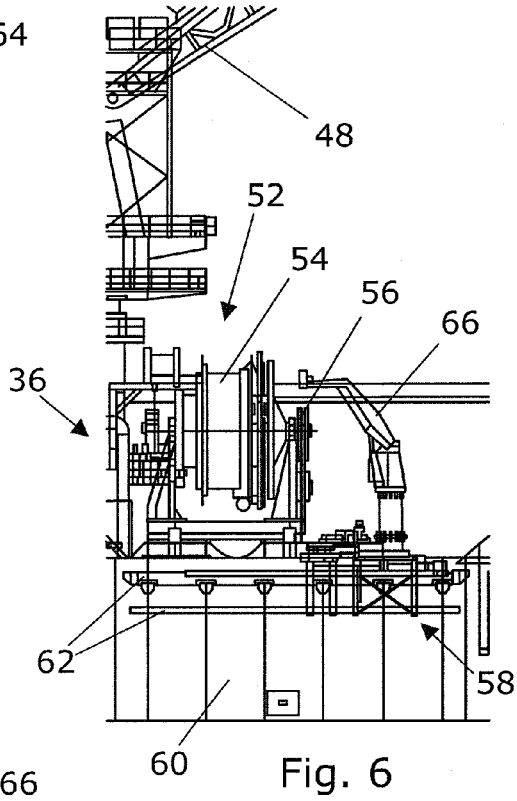
FIG. 6 is a partial side view of the lay barge of FIG. 3.

FIG. 6 shows how an ancillary crane 66 is positioned close to the deployment winch 52 to insert the chain 16, 20 into the gypsy wheel 56 (a process shown in FIG. 19, to be discussed below) and also to transfer elements of the various connectors to the hang-off platform 58 as will also be described in detail later.

Figure 7:
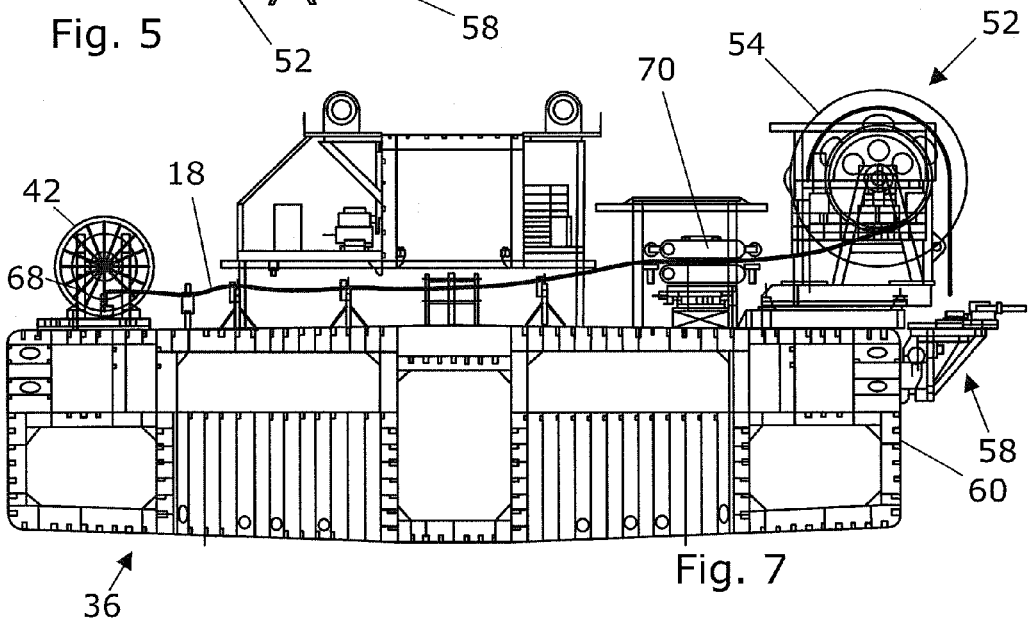
FIG. 7 is a cross-sectional view of the lay barge of FIG. 3 as wire is being trans-spooled.

FIG. 7 shows a trans-spooling operation in progress. A reel 42 of SSW 18 has been lifted from the cargo barge 38 by the auxiliary crane 50 of FIG. 3 and placed on a dolly base 68 beside the offloading chute 44 on the port side of the lay barge 36. From there, a transporter arrangement feeds the SSW 18 across to the starboard side of the lay barge 36, where it is then wound onto the drum 54 of the deployment winch 52. A service wire of the deployment winch 52 pulls the end of the SSW 18 onto the drum 54.

The SSW 18 is pre-fitted with padeye connector elements at both ends for connection to complementary connector elements of the bottom and top chains 16, 20 in due course. The padeye connector element at the leading end of the SSW 18 provides a convenient connection point for the transporter arrangement and for the service wire of the deployment winch 52.

A tensioner 70 maintains back-tension in the SSW 18 during trans-spooling and is mounted on a rack that oscillates fore-and-aft with respect to the lay barge 36 to work as a spooler during that operation. Typically the tensioner 70 will have a capacity of 20 tonnes and will apply 15 tonnes of back-tension to the SSW 18.

Figure 8:
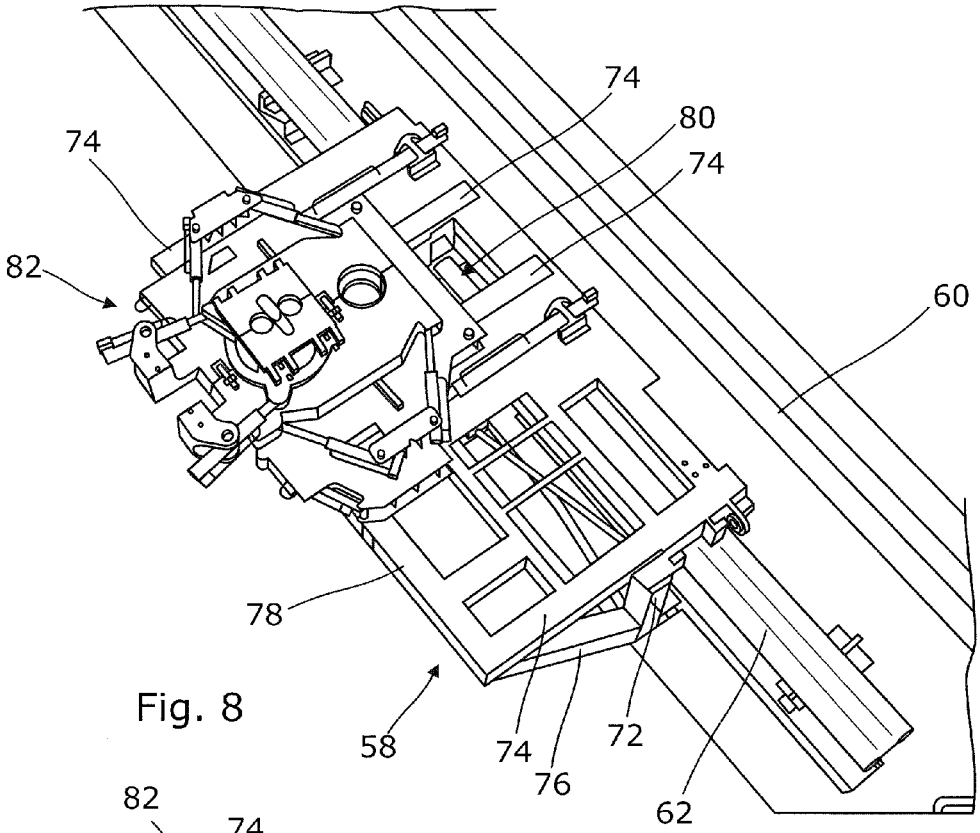
FIGS. 8 and 9 are perspective views of the hang-off platform showing its mounting to the lay barge of FIG. 3.
Figure 9:
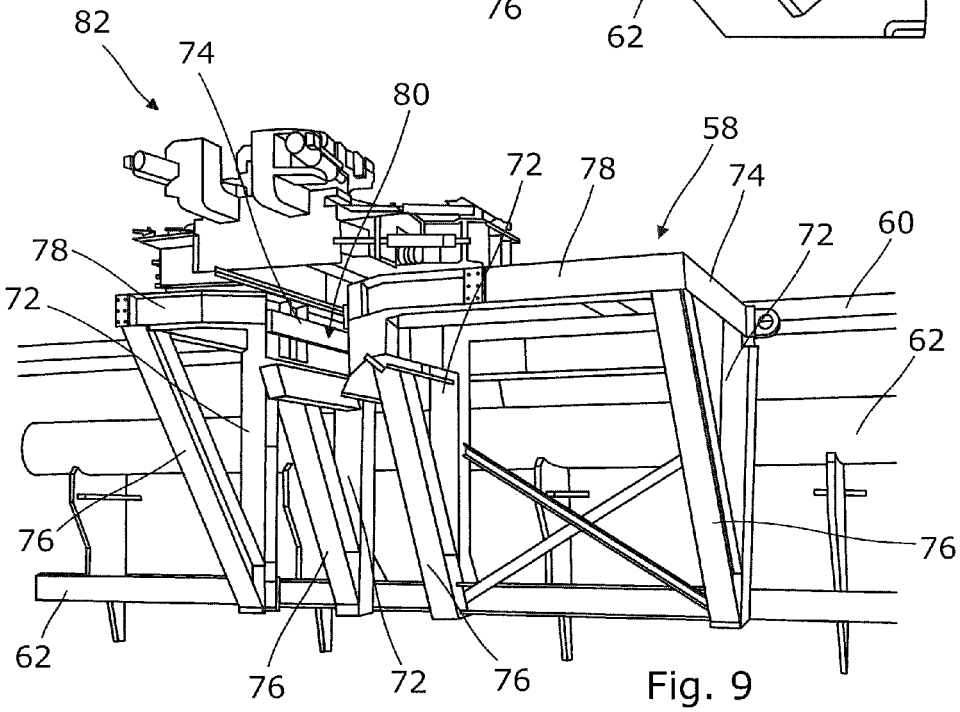

Moving on now to FIGS. 8 and 9, these show further details of the hang-off platform 58. The platform 58 comprises a framework of members that move together fore-and-aft along the rails 62. The members comprise four sets of uprights 72, outriggers 74 and struts 76.

The generally vertical uprights 72 on the inboard side of the platform 58 are attached to the rails 62 via bearings enabling relative fore-and-aft movement. In each of the four sets of members, the generally horizontal outrigger 74 extends in an outboard direction from the top of the upright 72 and the inclined strut 76 extends from the bottom of the upright 72 to the outboard end of the outrigger 74. Consequently, the port-to-starboard cross-section of the framework through the upright 72, outrigger 74 and strut 76 is generally that of an inverted right-angled triangle in which the strut 76 is the hypotenuse.

The sets of uprights 72, outriggers 74 and struts 76 are arranged in two pairs, each pair being joined by a respective longitudinal beam 78. Each beam 78 extends between the junctions of the outriggers 74 and struts 76 of the associated pair. A gap between the beams 78 of the respective pairs defines a slot 80 between the innermost two of the outriggers 74, that slot 80 being open at its outboard end.

The outriggers 74 support a carriage 82 in alignment with the slot 80. The carriage 82 will now be described in detail with reference to FIGS. 10 to 17 of the drawings.

Figure 10:
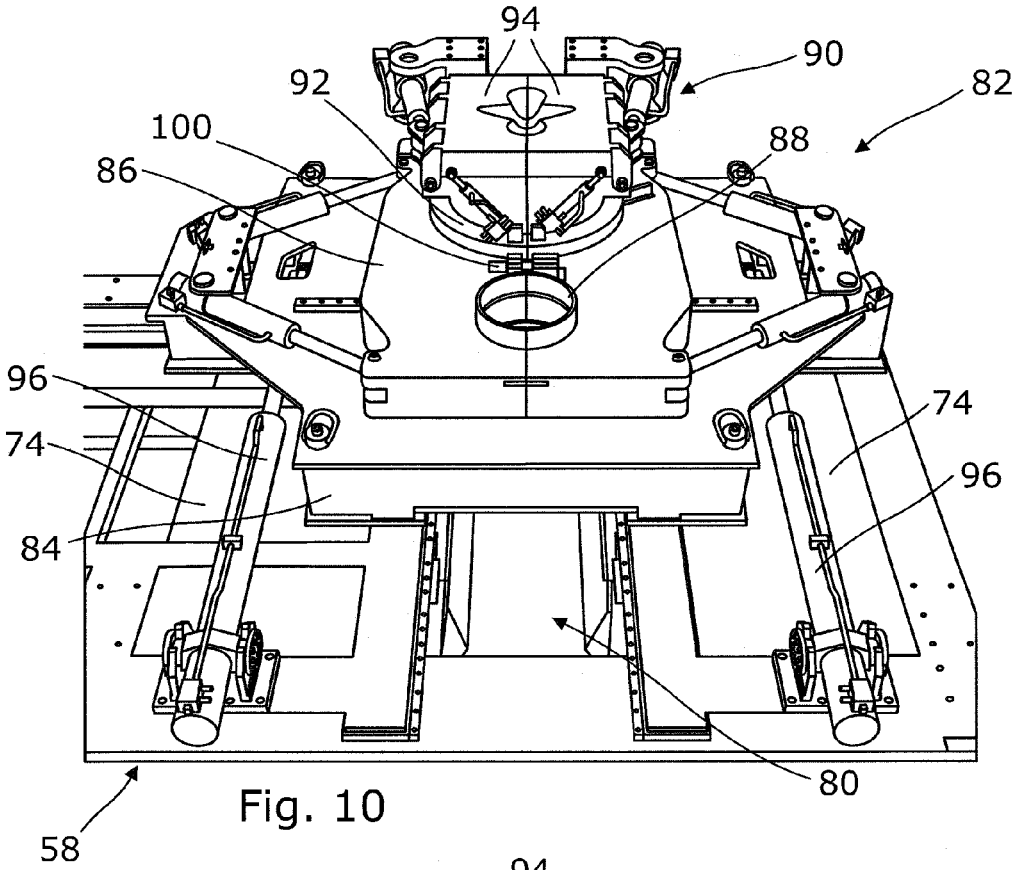
FIGS. 10 and 11 are perspective views of a carriage being part of the hang-off platform, respectively in outboard and inboard positions.
Figure 11:
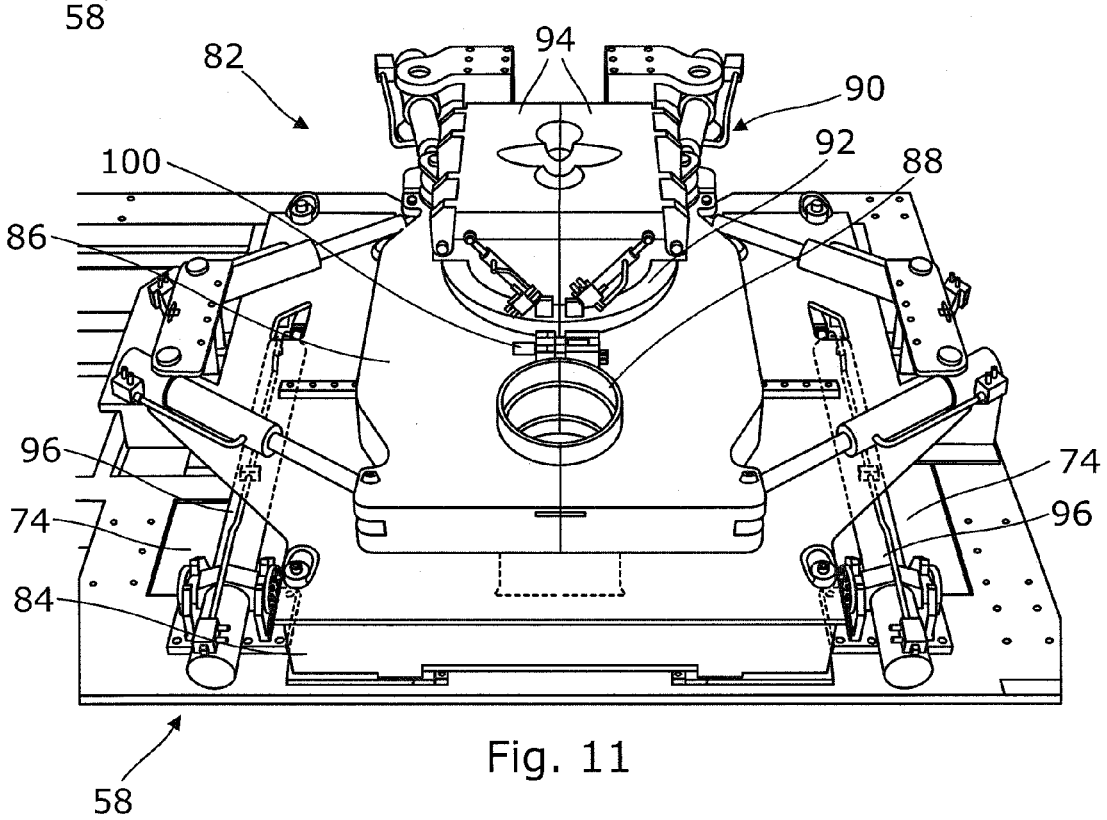

FIGS. 10 and 11 show how the carriage 82 comprises a chassis 84 surmounted by a platen 86. The platen 86 is penetrated by a socket 88 and also carries a clamp 90 aligned with and outboard of the socket 88.

As will be explained, the socket 88 is adapted to receive and engage elements of the connectors 30, 32, 34 used to connect the SSW section 18 of a mooring line 12 being deployed. As will also be explained, the clamp 90 is adapted to receive and engage chain 16, 20 used at the bottom and top of the mooring line 12. Via either the socket 88 or the clamp 90 as appropriate, the carriage 82 and the platform 58 are capable of supporting and transferring the load of the mooring line 12 to minimise intervention from cranes or winches on the lay barge 36.

The clamp 90 comprises a circular-section tubular collar 92 upstanding from the platen 86, which surrounds a hole penetrating the platen 86. Flaps 94 are pivotably mounted to the top of the collar 92. The flaps 94 are shown in a closed operational position in FIGS. 10 and 11, in which they cooperate to form a plate for receiving, engaging and supporting the chain 16, 20.

The features and operation of the platen 86, socket 88 and clamp 90 will be described in more detail below. Meanwhile, it should be noted from FIGS. 10 and 11 that the carriage 82 is movable inboard and outboard with respect to the platform 58 above the slot 80 defined between two outriggers 74. The carriage 82 is mounted to the platform 58 for sliding movement in a transverse direction perpendicular to the rails 62 on which the platform 58 itself moves fore and aft. That movement of the carriage 82 with respect to the platform 58 is driven by parallel rams 96, one on each outrigger 74 to each side of the slot 80.

By virtue of fore-and-aft longitudinal movement of the platform 58 with respect to the lay barge 36 and inboard-and-outboard lateral movement of the carriage 82 with respect to the platform 56, the carriage 82 may be moved horizontally to any location in a rectangular area situated outboard of the hull 60 of the lay barge 36 and generally below the deployment winch 52. That area encompasses, and extends beyond, the region below the deployment winch 52. Thus, the carriage 82 may be moved for the socket 88 to receive SSW 18 deployed by the drum 54 of the deployment winch 52 and for the clamp 90 to receive chain 16, 20 deployed by the gypsy wheel 56 of the deployment winch 52. The carriage 82 may also be moved for the socket 88 to receive elements of the connectors 30, 32, 34 used in the mooring line 12, before carrying those elements back to below the location where the SSW 18 emerges from the drum 54 of the deployment winch 52. It will be noted that due to spooling of the SSW 18 on the drum 54, that location will vary as the SSW 18 is deployed.

Figure 12:
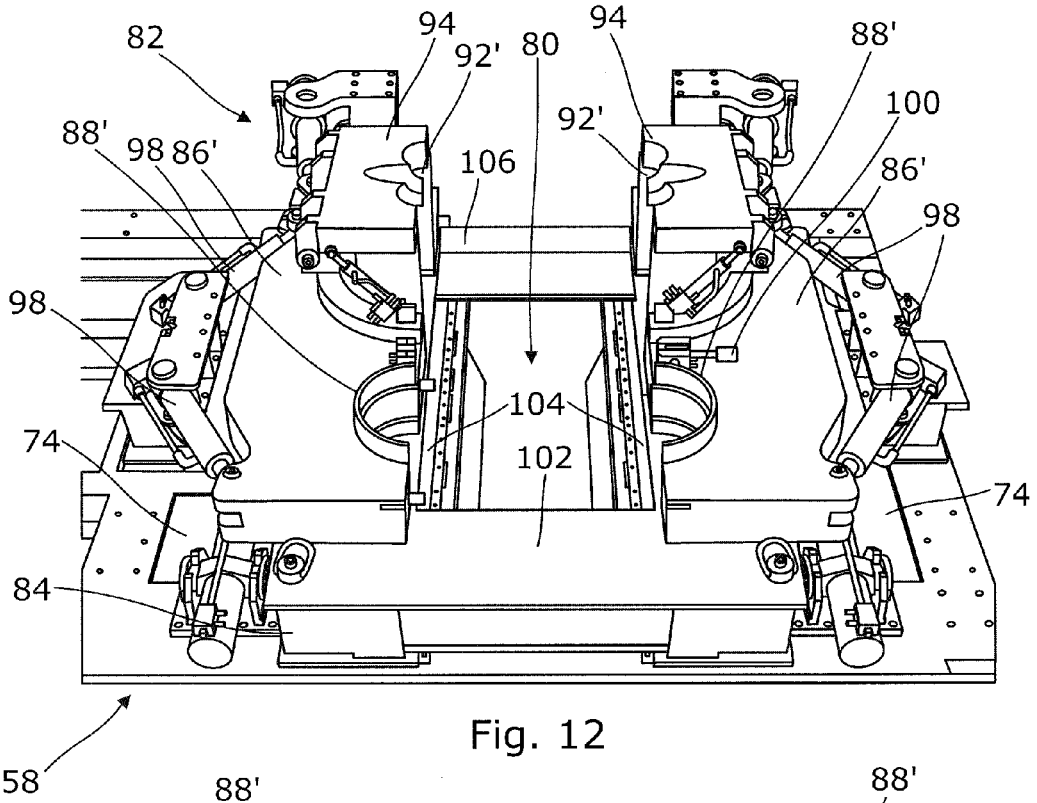
FIGS. 12 and 13 are perspective views of the carriage of FIGS. 10 and 11, with halves of the carriage separated to expose a slot in the hang-off platform, the outboard end of the slot being respectively closed and open.
Figure 13:
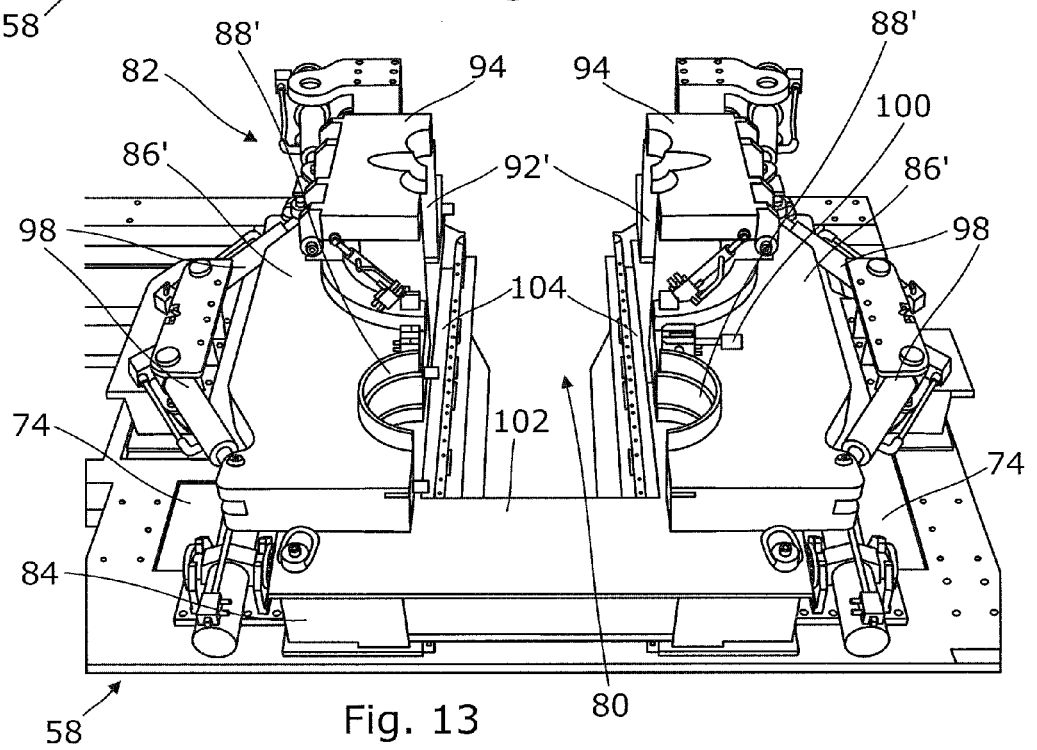

FIGS. 12 and 13 show that the platen 86 of the carriage 82 is divided along a vertical outboard-extending plane that bisects the socket 88 and the clamp 90. The platen 86 thus defines opposed jaws 86' that may be moved horizontally apart and together again with respect to the chassis 84 by means of rams 98 acting between the chassis 84 and the jaws 86'. A latch lever 100, when closed, confirms that the jaws 86' are locked together and must be released as shown in FIGS. 12 and 13 when the jaws 86' are to be moved apart. The latch lever 100 is shown in the closed position in FIGS. 10 and 11.

The socket 88 and the clamp 90 also divide as the platen 86 divides. A respective semi-circular half 88' of the socket 88 moves with each jaw 86' such that the circular socket 88 is completed when the jaws 86' come together. Similarly, a respective semi-circular half 92' of the collar 92 moves with each jaw 86' such that the semi-circular collar 92 is completed when the jaws 86' come together. Also, each half of the collar 92 carries a respective one of the flaps 94.

FIGS. 12 and 13 also show how the chassis 84 is generally U-shaped in plan view. More specifically, the chassis 84 comprises an inboard cross-member 102 parallel to the hull 60 of the lay barge 36 and two outboard-extending arms 104, the arms 104 defining a gap between them aligned with the slot 80. The gap has an open outboard end but may be closed by a hinging gate member 106 shown closed in FIG. 12 and open in FIG. 13. When in its normal closed state, the gate member 106 adds to the structural integrity of the carriage 82. As will be described, the gate member 106 need be opened only to allow the mooring line 102 to be abandoned, at which stage the carriage 82 no longer bears the load of the mooring line 102.

Figure 15:
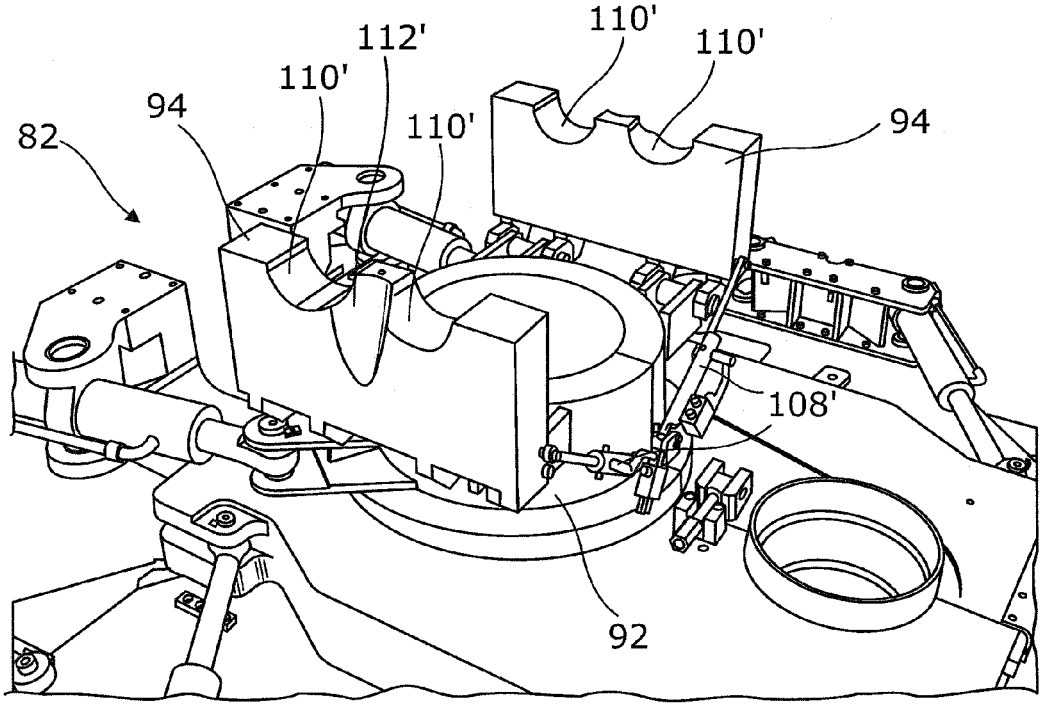

As mentioned above, the flaps 94 are pivotably mounted to the top of the collar 92. Each flap 94 is hinged about a respective generally horizontal axis, the axes being parallel to each other. FIG. 15 shows how the flaps 94 may thereby be raised into an open clearance position by means of rams 108 acting between the collar 92 and the flaps 94.

Figure 14:
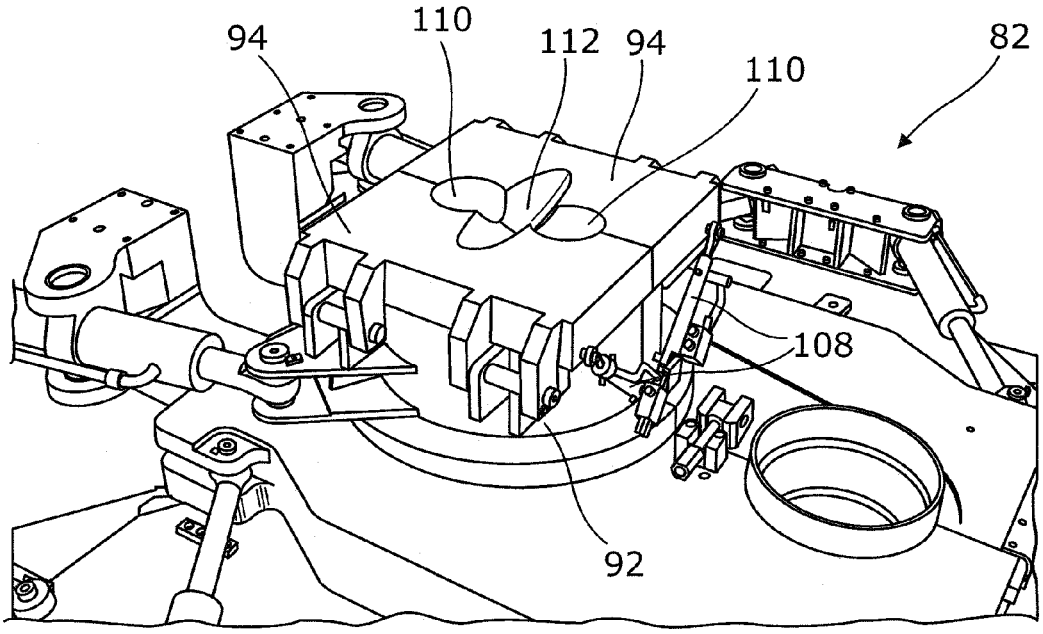
FIGS. 14 and 15 are enlarged perspective views of the carriage of FIGS. 10 and 11, showing a detail in the form of flaps respectively in closed and open states.

When lowered into the closed operational position shown in FIG. 14, the flaps 94 cooperate to form a square plate for receiving, engaging and supporting the chain 16, 20 as noted above. That plate has chain-engaging formations comprising spaced holes 110 for accommodating a lower chain link and an elongate ellipsoidal cup 112 extending transversely between the holes for seating an upper chain link. The holes 110 and the cup 112 are bisected by the division between the flaps 94; the free edge of each flap 94 therefore has semi-circular cut-outs defining half 110' of each hole 110 and a recess 112' defining half of the cup 112, as FIG. 15 makes clear.

Figure 16:
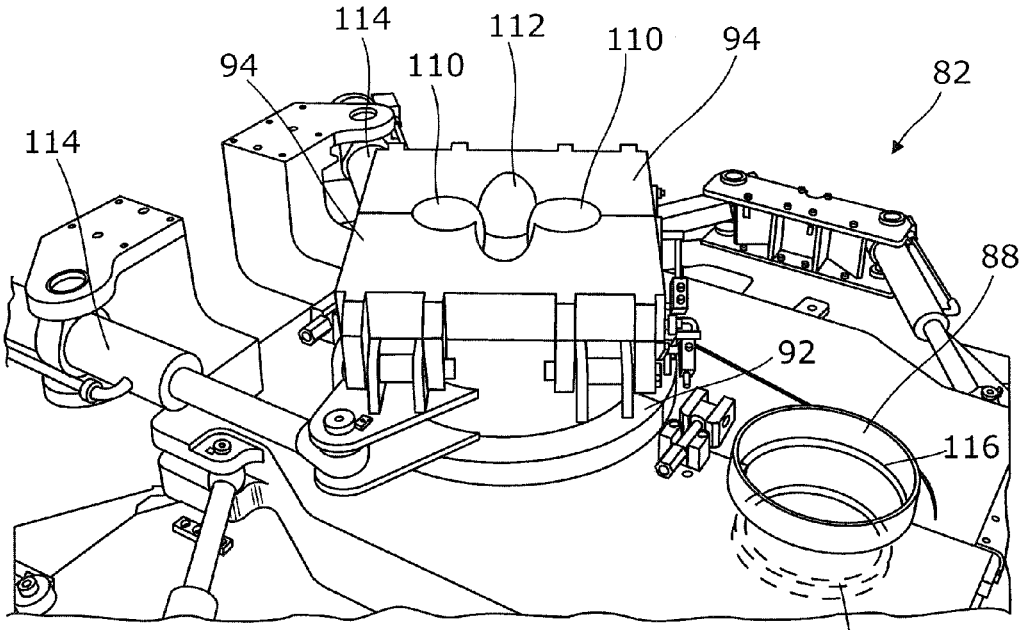
FIGS. 16 and 17 are enlarged perspective views of the carriage of FIGS. 10 and 11, showing a collar carrying the flaps pivoted respectively anticlockwise and clockwise with respect to the remainder of the carriage.
Figure 17:
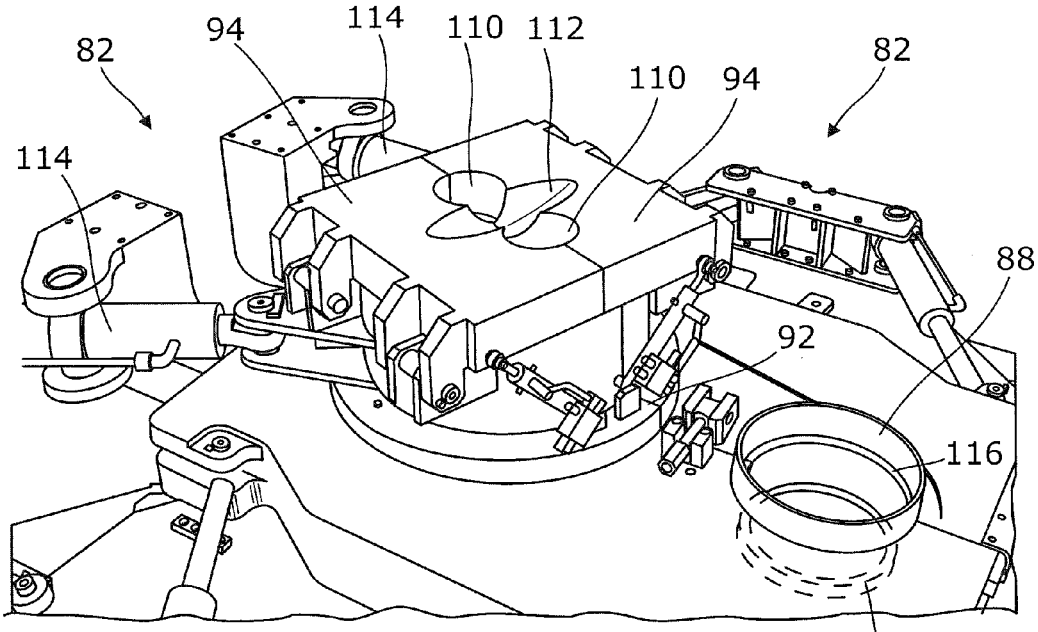

FIGS. 16 and 17 show how the collar 92 is pivotable with respect to the platen 86 by virtue of opposed rams 114 acting between the collar and the platen 86. By extending and contracting in synchronisation, the rams 114 can turn the collar 92—and hence the chain-engaging formations 110, 112 defined by the flaps 94—to match the orientation of chain links hanging from the gypsy wheel 56 of the deployment winch 52 or the SSW socket hanging from the drum 54 of the deployment winch 52. The range of pivotal movement is approximately 90°, being approximately ±45° about a central orientation in which the pivot axes of the flaps 94 are parallel to the plane on which the socket 88 and the collar 92 are centred.

A final detail of the carriage 82 is also best shown in FIGS. 16 and 17, namely that the socket 88 has a stepped cross-section that narrows with increasing depth. That cross-section defines formations such as shoulders 116 shaped to co-operate, engage with and support various types of connector elements.

Figure 18:
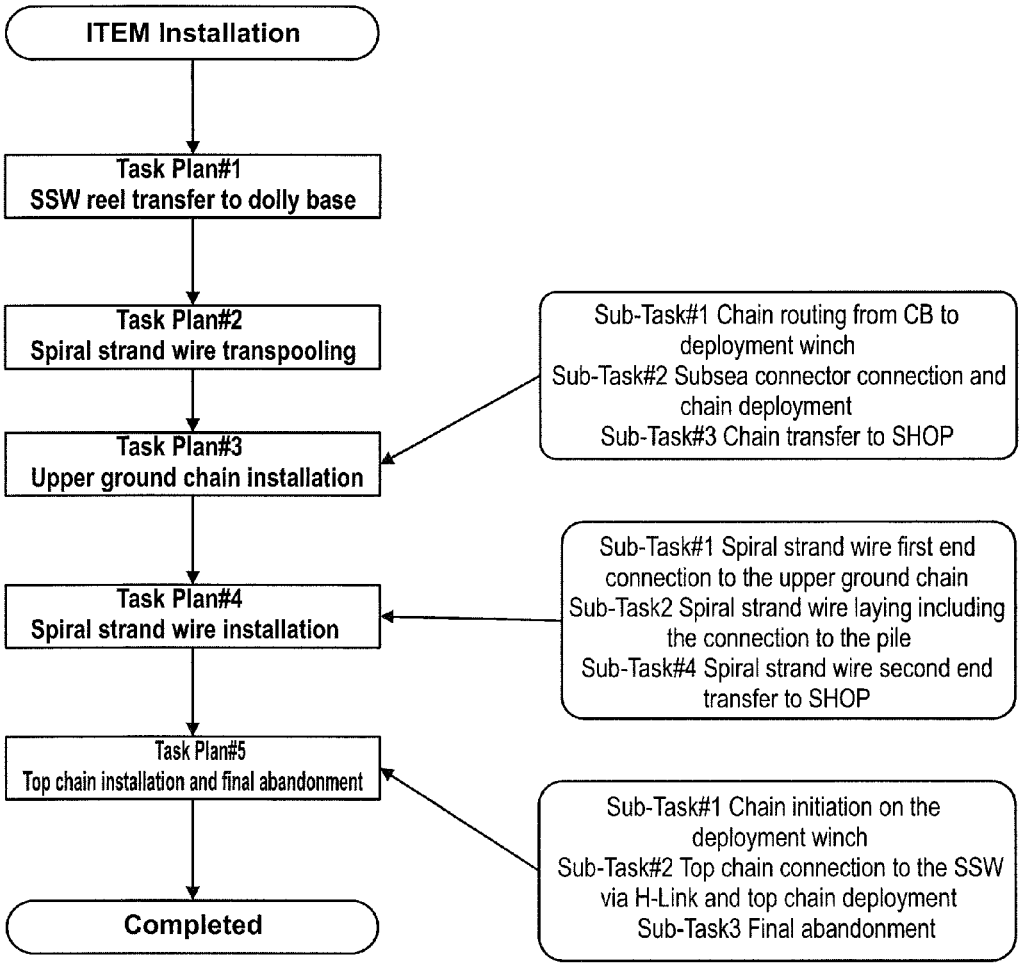
FIG. 18 is a flow diagram summarising method steps involved in installing and abandoning a mooring line using a pre-installed anchor such as a suction pile.

Having now described the lay barge 36 and details of the platform 58 and carriage 82, their operation when installing a mooring line 12 will now be described. The general process is summarised in FIG. 18 and the first two steps—namely transferring the reel 42 of SSW 18 to the dolly 68 and then transspooling the SSW 18 from the reel 42 to the drum 54 of the deployment winch 52—have already been described.

Figure 19:
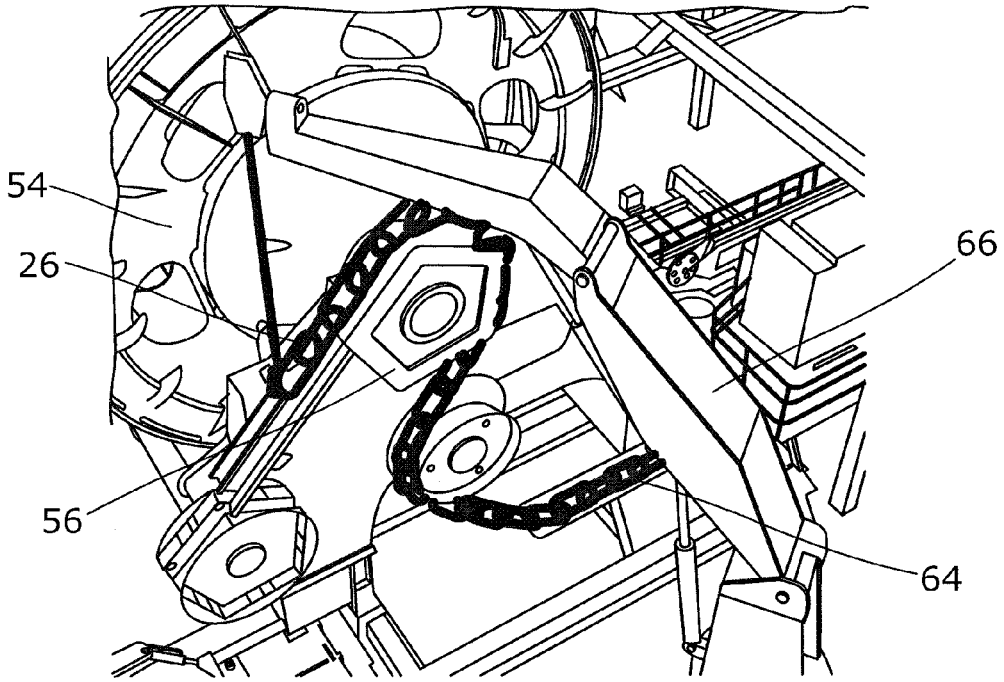
FIG. 19 is a perspective view of the upper ground chain being routed around a gypsy wheel of a deployment winch.

FIG. 19 shows the ancillary crane 66 being used to insert the upper section 26 of the ground chain 16 into the gypsy wheel 56. In this respect, it will be recalled that the lower section 24 of the ground chain 16 is pre-attached to the associated suction pile 14 before the suction pile 14 is overboarded and lowered to penetrate the seabed 10. The main crane 48 of the lay barge 36 shown in FIG. 3 is used to overboard the suction pile 14, whose load is then transferred to an A&R winch that lowers the suction pile 14 from approximately 30 m underwater to the seabed 10 and so frees the main crane 48 for other duties. However it would be possible in principle to use the main crane 48 to lower the suction pile 14 all the way to the seabed 10.

Figure 20:
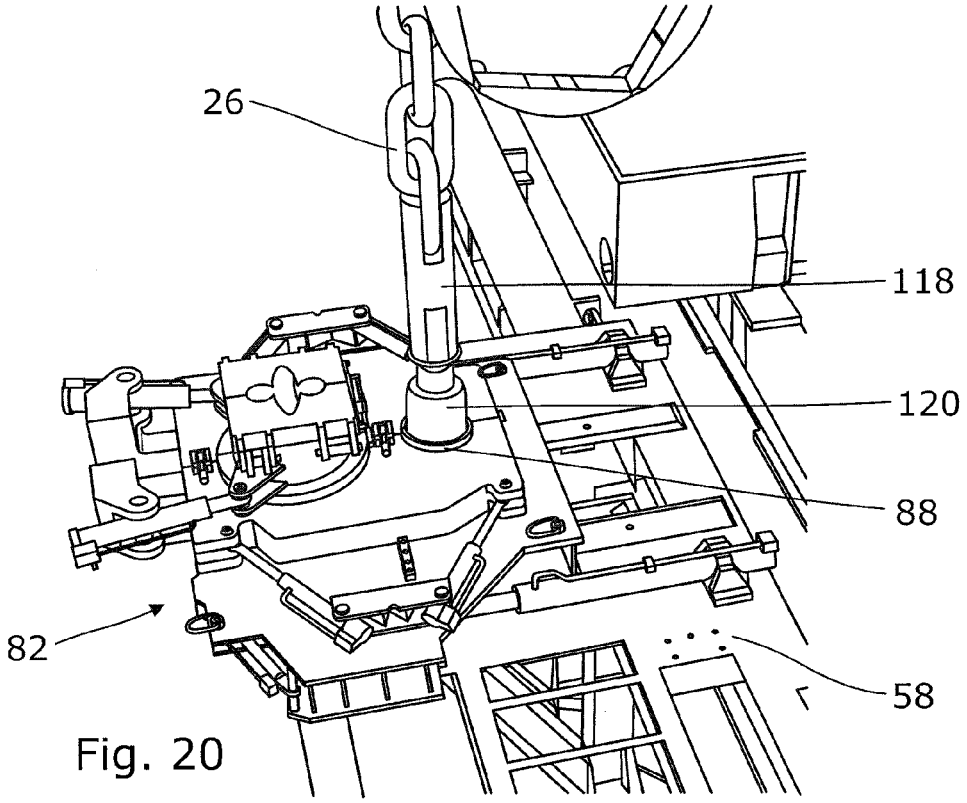
FIG. 20 is a perspective view of the upper ground chain being affixed to a subsea connector element supported by a connector socket in the carriage of the hang-off platform.

Once the upper section 26 of the ground chain 16 has been inserted into the gypsy wheel 56 as shown in FIG. 19, the gypsy wheel 56 is turned to lower the end of the upper section 26 to just above the level of the hang-off platform 58. Meanwhile the carriage 82 of the hang-off platform 58 is moved to present its connector socket 88 to the ancillary crane 66. The ancillary crane 66 then lifts elements of connector 30 into the socket 88, those elements being a Y-link 118 atop a male element 120 of a Balltec subsea connector. Then, the carriage 82 moves into alignment with the gypsy wheel 56 to align the Y-link 118 with the end of the upper section 26, whereupon the end of the chain is fixed to the Y-link 118 as shown in FIG. 20.

Figure 21:
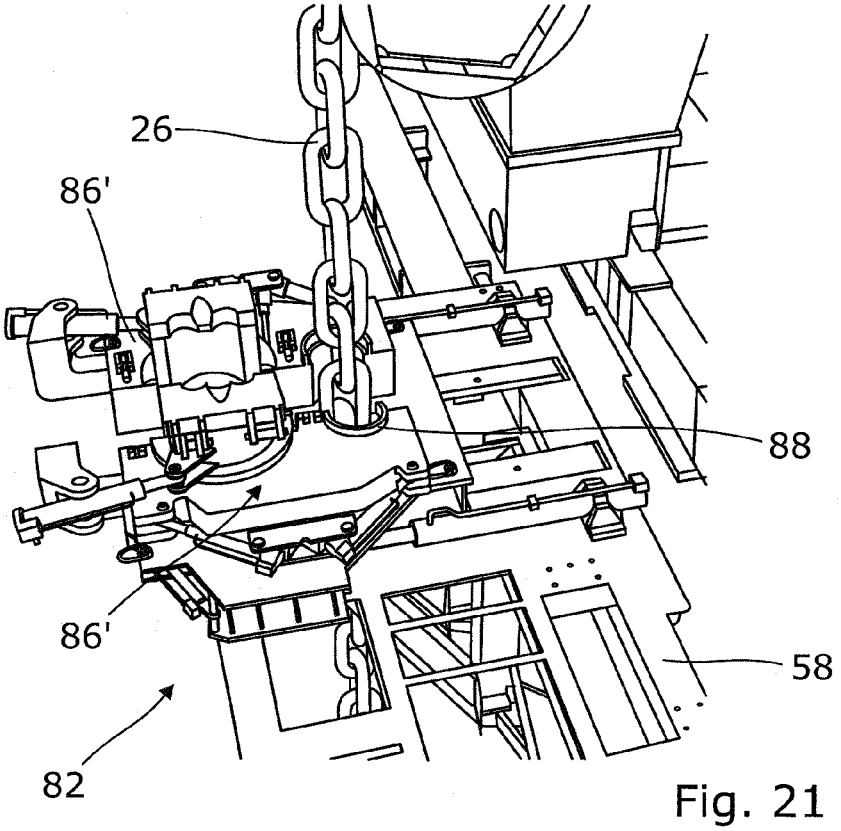
FIG. 21 is a perspective view of the carriage halves separated to free the subsea connector element and the upper ground chain for deployment by the winch.

The upper section 26 of the ground chain 16 is now ready for deployment overboard into the sea. To enable this, the jaws 86' of the platen 86 of the carriage 82 are separated to split the socket 88 as shown in FIG. 21. This disengages the male connector element 120 from the socket 88 and provides clearance for the upper section 26 of the ground chain 16 to pass between the jaws 86' as the chain is deployed by rotation of the gypsy wheel 56.

Figure 22:
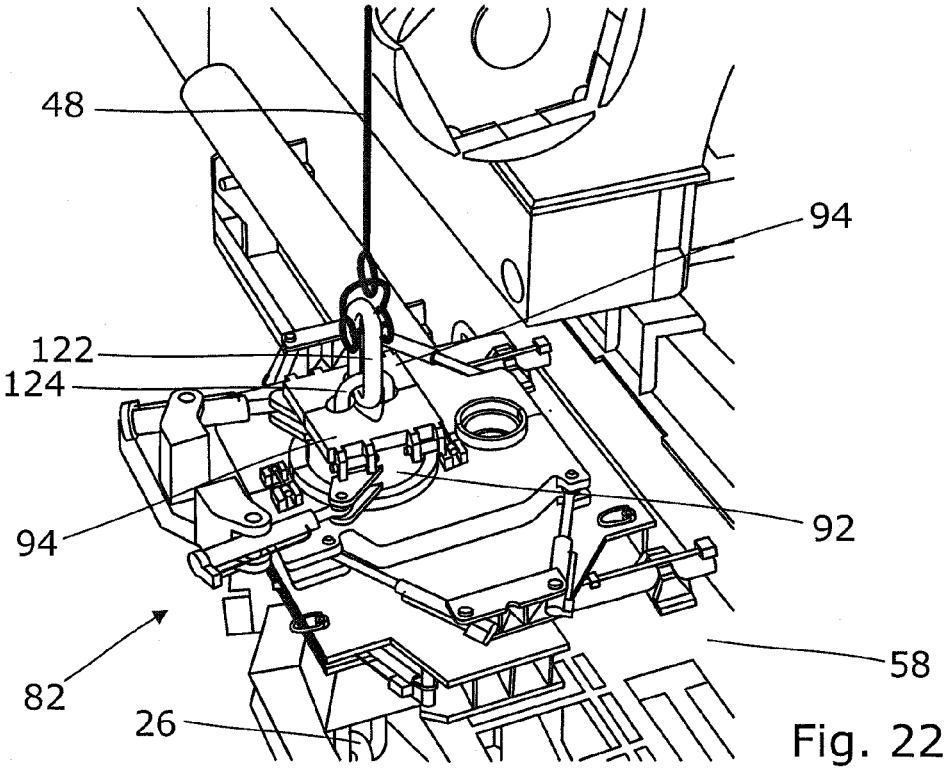
FIG. 22 is a perspective view of the carriage halves closed again to seat the upper end of the upper ground chain in the closed jaws of the carriage.

FIG. 22 shows the carriage 82 repositioned and reconfigured after the full length of the upper section 26 of the ground chain 16 has been deployed. The main crane 48 has lifted the upper end of the chain clear of the gypsy wheel 56 and then lowered the chain such that the chain link 122 at the upper end is just above the collar 92 of the carriage 82. As the jaws 86' of the carriage 82 were still open during that movement, the collar 92 was split whereby the collar 92 could readily embrace the chain. For this purpose, the carriage 82 has been moved inboard relative to the platform 58 to align the collar 92 with the chain.

The jaws 86' have then been brought together to complete the collar 92 around the chain. The collar 92 may then be pivoted if necessary to align the chain-engaging formations 110, 112 of the flaps 94 with the orientation of the chain links, whereupon the flaps 94 are lowered to engage the chain links. The link 122 at the upper end of the chain is received by the cup 112 and the penultimate link 124 of the chain is received by the holes 110. The horizontal plate defined by the cooperating lowered flaps 94 now bears the full load of the upper section 26 of the ground chain 16, meaning that the main crane 48 is free for other duties.

Figure 23:
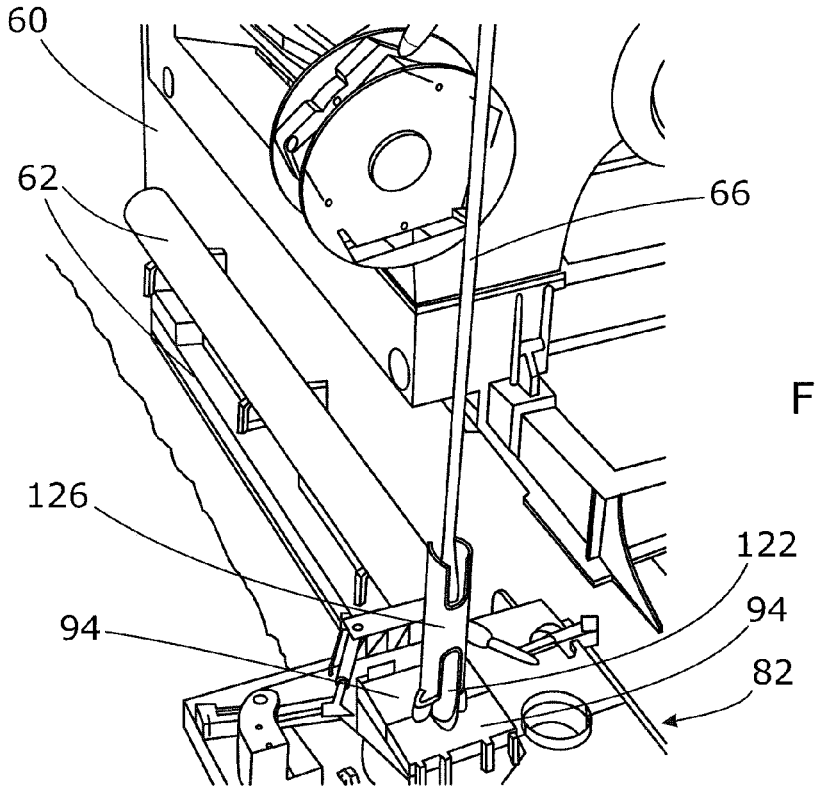
FIG. 23 is a perspective view of the carriage moved to attach a connector to the upper end of the upper ground chain.
Figure 24:
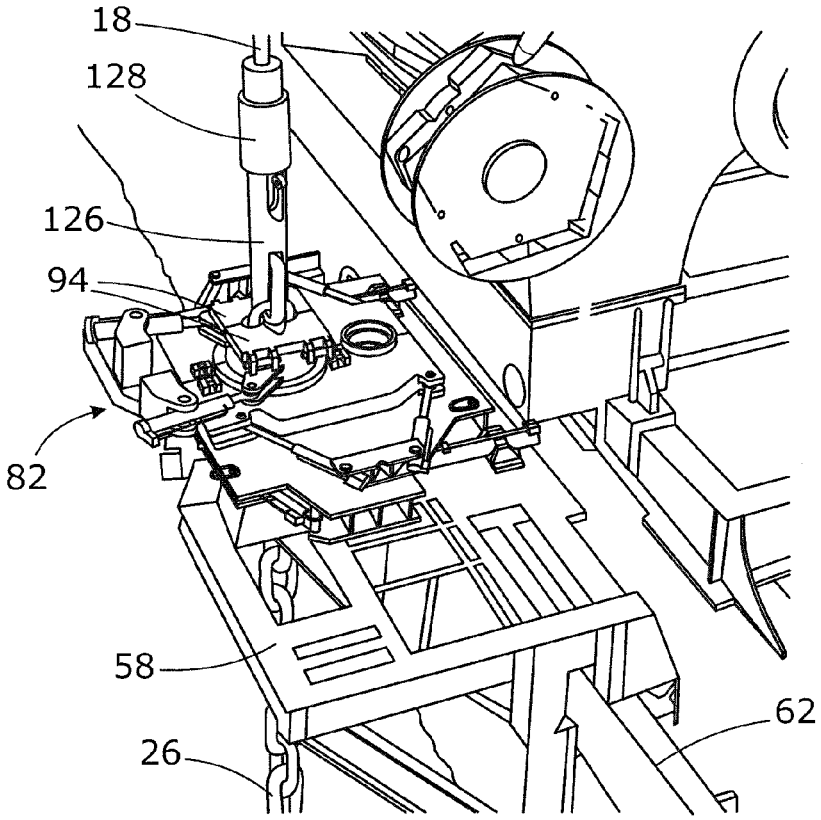
FIG. 24 is a perspective view of the carriage moved back to attach a lower end of the spiral strand wire (SSW) to the connector at the upper end of the upper ground chain.

FIG. 23 shows the next operation, which is to use the ancillary crane 66 to lift an H-link connector 126 into engagement with the exposed chain link 122 supported by the flaps 94 of the carriage 82. For this purpose, the carriage 82 is moved toward the ancillary crane 66 by moving the platform 58 forward along the rails 62 with respect to the hull 60 of the lay barge 36. Next, the carriage is moved into alignment with the drum 54 of the deployment winch 52 by moving the platform 58 aft along the rails 62. This is shown in FIG. 24, which also shows how a padeye connector element 128 pre-installed on the bottom end of the SSW 18 is lowered by the deployment winch 52 into engagement with the aligned H-link connector 126.

Figure 25:
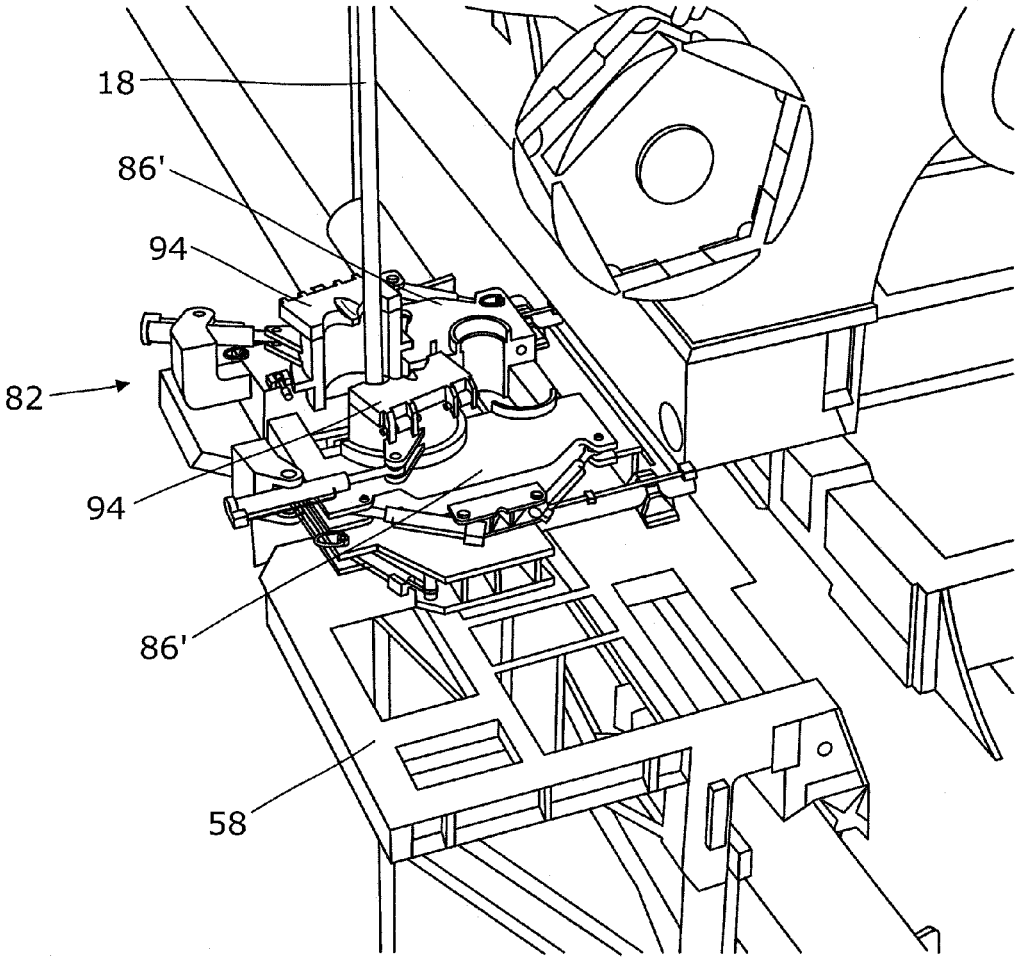
FIG. 25 is a perspective view of the carriage halves separated to free the connector and the spiral strand wire for deployment by the winch.

Via the SSW 18, the deployment winch 52 may now take the load of the deployed upper section 26 of the ground chain 16. This enables the jaws 86' of the carriage 82 to be opened once more as shown in FIG. 25, freeing the chain from the flaps 94 and allowing the SSW 18 to be deployed from the drum 54 of the deployment winch 52. The upper section 26 of the ground chain 16 hangs from the SSW 18 until it reaches the seabed 10 as will now be described.

Fore-and-aft unspooling movement of the SSW 18 with respect to the deployment winch 52 may be accommodated by moving the platform 58 fore-and-aft to keep the carriage 82 in alignment with the SSW 18 throughout deployment.

FIG. 26*a* shows how the upper section 26 of the ground chain 16 is handled underwater during the deployment process. For better control, an ROV 130 connects an auxiliary winch wire 132 to the upper section 26 of the ground chain 16, near its lower end. This leaves a short free end portion 134 of the upper section 26 hanging from the auxiliary winch wire 132. The remainder of the upper section 26 hangs as a catenary between the auxiliary winch wire 132 and the deployment winch 52 via the SSW 18. The auxiliary winch wire 132 is paid out as the deployment winch 52 lowers the free end portion 134 of the upper section 26 toward the suction pile 14.

FIG. 26*b* best shows how the lower section 24 of the ground chain 16 was attached to the suction pile 14 before the suction pile 14 was installed. The lower section 24 extends upwardly along the side wall of the suction pile 14 from the connector 28 positioned at a low level on that side wall. At its upper end, the lower section 24 of the ground chain 16 terminates in a female subsea connector socket that remains fixed temporarily to the upper exposed end of the suction pile 14 during installation of the pile 14.

To complete the ground chain 16, the male connector element 120 (shown in FIG. 20) at the bottom end of the upper section 26 of the ground chain 16 is guided by an ROV 130 into the socket at the top end of the lower section 24 of the ground chain 16. There, the male connector element 120 engages with the socket to complete the subsea connector 30 as shown in FIG. 26*b*.

The subsea connector 30 may then be detached by an ROV 130 from the suction pile 14 so that the full length of the ground chain 16 can extend freely from the suction pile 14 while its bottom end remains anchored by the connector 28 to the buried side wall of the suction pile 14. FIG. 27 shows the lower section 24 of the ground chain 16 inclined away from the suction pile 14 as the lay barge 36 deploys the SSW 18 and moves relative to the seabed 10 to follow the desired lay path of the mooring line 12 shown in FIG. 1. The touchdown point is continuously monitored by an ROV 130.

Deployment of the SSW 18 continues until all of the SSW 18 has been paid out from the drum of the deployment winch 52. At that stage, as shown in FIG. 28, the SSW 18 hangs from the service wire 136 of the deployment winch 52, which remains joined to a padeye connector element 128 pre-installed at the top end of the SSW 18. Now, the carriage 82 has again repositioned and reconfigured, having first moved outboard to align the socket 88 with the connector element 128 while the jaws 86' of the carriage 82 were still open. Thus, the socket 88 was split whereby the socket 88 could readily embrace the SSW 18 hanging below the connector element 128.

Now, the jaws 86' have been brought together to complete the socket 88 around the SSW 18, whereupon the connector element 128 has been lowered into and engaged with the socket 88 as shown in FIG. 28. The socket 88 now bears the full load of the upper section 26 of the ground chain 16 and the SSW 18 hanging between the connector element 128 and the seabed 10. The service wire 136 may now be disconnected from the connector element 128, ready for the engagement of an H-link connector 126 lifted by the ancillary crane 66 as shown in FIG. 29. To do so, the platform 58 is moved forward along the rails 62 to move the carriage 82 out of alignment with the drum 54 of the deployment winch 52 to within the working radius of the ancillary crane 66.

When the H-link connector 126 has been engaged with the connector element 128, the platform 58 is moved aft along the rails 62 to move the carriage 82 back into alignment with the gypsy wheel 56 of the deployment winch 52. Here, as shown in FIG. 30, the top chain 20 inserted previously into the gypsy wheel 56 by the ancillary crane 66 is lowered into engagement with the H-link connector 126. Now, the deployment winch 52 may again take the load of the upper section 26 of the ground chain 16 and the SSW 18 hanging above the seabed 10. The jaws 86' of the carriage separate again as shown in FIG. 31 to split the socket 88 and hence disengage the connector element 128 from the socket 88, freeing the top chain 10 to be deployed into the sea.

FIG. 32 shows the carriage 82 repositioned and reconfigured after the full length of the top chain 20 has been deployed. The main crane 48 has lifted the upper end of the chain 20 clear of the gypsy wheel 56 and then lowered the chain 20 such that four chain links 138 at the upper end are just above the collar 92 of the carriage 82. As the jaws 86' of the carriage 82 were still open during that movement, the collar 92 was split whereby the collar 92 could readily embrace the chain 20. For this purpose, the carriage 82 has again been moved inboard relative to the platform 58 to align the collar 92 with the chain 20.

The jaws 86' have then been brought together to complete the collar 92 around the chain 20. As before, the collar 92 may be pivoted if necessary to align the chain-engaging formations 110, 112 of the flaps 94 (as shown in FIGS. 16 and 17) with the orientation of the chain links 138, whereupon the flaps 94 are lowered to engage the chain links 138. The fourth link 138 in from the upper end of the chain 20 is received by the cup 112 and the link 138 below that is received by the holes 110. The horizontal plate defined by the cooperating lowered flaps 94 now bears the full load of the top chain 20, the SSW 18 and the bottom chain 16 extending from the carriage 82 to the seabed 10.

As FIG. 33 shows, a sling 140 from the main crane 48 may then be reconnected to the top chain 20 a few links down from the end. The end link of the top chain 20 is then fitted with a loop 142 to facilitate transferring the load underwater to the A&R winch of the lay barge 36. However it is also possible for the main crane 48 to abandon the top chain 20 all the way to the seabed 10. It will be noted in this respect that the hinging gate member 106 of the carriage 82 has opened in FIG. 33 to allow the top chain 20 to be pulled by the main crane 48 in an outboard direction out of and away from the carriage 82 before being abandoned. The jaws 86' of the carriage 82 have opened to disengage the links 138 of the top chain 20 from the flaps 94 and to provide clearance for outboard movement of the top chain 20 out of the carriage 82.

Referring finally to FIGS. 34*a* and 34*b* of the drawings, these show the mooring line 12 being finally abandoned on the seabed 10 by the A&R winch 144 of the lay barge 36. An ROV 130 has disconnected the loop 142 from the top chain 20. A float arrangement 146 near the end of the mooring line assists a subsequent recovery procedure. It will be noted that an anti-twist arm 148 projects perpendicularly with respect to the wire 150 of the A&R winch 144 to ease control of the mooring line 12 during abandonment.

The invention claimed is:

1. A line-handling apparatus for use in assembling a line being deployed from a vessel, that line comprising at least two sections in longitudinal sequence, wherein the apparatus comprises a hang-off carriage mounted to an outrigger platform that is movable along the hull of the vessel, the hang off carriage being movable on or relative to the platform and having at least one line support adapted to support the line, the line support being capable of supporting a length of line hanging from the carriage via that support, the carriage being movable in two horizontal orthogonal axes by movement of the carriage on or relative to the platform and movement of the platform along the hull of the vessel such that the carriage is movable around a horizontal area located beneath separate line deployment locations on the vessel spaced horizontally from each other, to align the line support with each line deployment location, and to move the supported length of line between the line deployment locations for connection of subsequent sections of the line.

2. The apparatus of claim 1, wherein at least one of the line sections is a wire and the carriage has a wire support adapted to support the wire.

3. The apparatus of claim 1, wherein at least one of the line sections is a chain and the carriage has a chain support adapted to support the chain.

4. The apparatus of claim 1, wherein the line comprises at least one section of chain in longitudinal sequence with at least one section of wire and the carriage comprises: a chain support adapted to support the chain; and a wire support adapted to support the wire; and the line deployment locations are chain and wire deployment locations, the carriage being movable to align the chain support with the chain deployment location and the wire support with the wire deployment location, and to move the supported length of line between said deployment locations for connection of subsequent sections of the line.

5. The apparatus of claim 1, wherein the line support is adapted to support a connector element that is attached or attachable to a line section.

6. The apparatus of claim 1, wherein the platform is mounted to the vessel by at least one rail extending generally horizontally along the hull.

7. The apparatus of claim 1 wherein the platform is mounted to the vessel by at least one rail extending generally horizontally along the hull.

8. The apparatus of claim 1, wherein the platform defines a slot for accommodating a hanging chain or wire, that slot extending in an outboard direction and being open to its outboard end.

9. The apparatus of claim 8, wherein the carriage defines a gap aligned with the slot of the platform.

10. The apparatus of claim 9, wherein the carriage comprises a chassis having spaced arms that define the gap between them.

11. The apparatus of claim 10, wherein the chassis is generally U-shaped, having generally parallel arms joined by a cross-member.

12. The apparatus of claim 9, wherein the carriage comprises a gate member on its outboard side that closes the gap and can be opened to abandon the line.

13. The apparatus of claim 1, wherein the line support comprises portions that are separable to allow the line to be deployed.

14. The apparatus of claim 13, wherein the carriage comprises a platen that carries the line support, the platen being separable into jaws that divide the line support.

15. The apparatus of claim 14, wherein:

the carriage is mounted to an outrigger platform that is movable along the hull of the vessel; the platform defines a slot for accommodating a hanging chain or wire, that slot extending in an outboard direction and being open to its outboard end; the carriage comprises a chassis having spaced arms that define a gap between them aligned with the slot of the platform; and a junction between the jaws extends along the gap in the chassis.

16. The apparatus of claim 1, wherein the line support comprises a socket that narrows downwardly.

17. The apparatus of claim 16, wherein the socket comprises formations shaped to complement different connector elements.

18. The apparatus of claim 1, wherein at least one line support is a chain support comprising a collar for surrounding a chain, which collar supports chain-engaging members that are co-operable to embrace and engage the chain.

19. The apparatus of claim 18, wherein the chain-engaging members cooperate to define a plate that is supported on top of the collar.

20. The apparatus of claim 18, wherein the chain-engaging members have chain-engaging formations shaped to engage successive links of the chain.

21. The apparatus of claim 20, wherein the collar is pivotable about the longitudinal axis of the chain to align the chain-engaging formations with the links of the chain.

22. The apparatus of claim 18, wherein the chain support comprises portions that are separable, those portions including portions of the collar and respective chain-engaging members attached to each portion of the collar.

23. The apparatus of claim 1, wherein the horizontal area in which the carriage is movable extends beyond at least one of the deployment locations.

24. The apparatus of claim 23, wherein the area extends to within the working radius of a crane for loading a connector element onto the line support.

25. The apparatus of claim 1, and having at least two line supports adapted to support different types of line.

26. The apparatus of claim 25, wherein the line supports are disposed one outboard and one inboard of the other.

27. A line-handling method for use in assembling a line being deployed from a vessel, that line comprising at least two sections in longitudinal sequence, wherein the method comprises supporting the line to hang from a carriage mounted to an outrigger platform that is movable along the hull of the vessel, the hang off carriage being moveable on or relative to the platform and movable in two horizontal orthogonal axes by movement of the carriage on or relative to the platform and movement of the platform along the hull of the vessel such that the carriage is movable around a horizontal area located beneath deployment locations on the vessel spaced horizontally from each other, and moving the carriage to bring the line into alignment with a deployment location for connection of subsequent sections of the line.

28. The method of claim 27, wherein the line comprises at least one section of chain in longitudinal sequence with at least one section of wire and the method comprises moving a supported length of the chain into alignment with a wire deployment location, and/or moving a supported length of the wire into alignment with a chain deployment location.

29. The method of claim 27, comprising moving the carriage generally horizontally along the hull of the vessel.

30. The method of claim 27, comprising moving the carriage inboard or outboard with respect to the hull of the vessel.

31. The method of claim 27, comprising moving the carriage within the working radius of a crane, using the crane to load a connector element onto the carriage, and moving the carriage to carry the connector element into alignment with a line deployment location.

32. The method of claim 27, comprising dividing part of the carriage to provide clearance for deployment of the chain or wire without moving the carriage.

33. The method of claim 27, comprising abandoning the line from the carriage in an outboard direction.

34. The method of claim 33, comprising opening part of the carriage to permit said abandonment.

35. A vessel fitted with a line-handling apparatus for use in assembling a line being deployed from the vessel, that line comprising at least two sections in longitudinal sequence, wherein the apparatus comprises a hang-off carriage mounted to an outrigger platform that is movable along the hull of the vessel, the hang off carriage being moveable on or relative to the platform and having at least one line support adapted to support the line, the line support being capable of supporting a length of line hanging from the carriage via that support, the carriage being movable in two horizontal orthogonal axes by movement of the carriage on or relative to the platform and movement of the platform along the hull of the vessel such that the carriage is movable around a horizontal area located beneath separate line deployment locations on the vessel spaced horizontally from each other, to align the line support with each line deployment location, and to move the supported length of line between the line deployment locations for connection of subsequent sections of the line.

36. A vessel operating with a line-handling method for use in assembling a line being deployed from the vessel, that line comprising at least two sections in longitudinal sequence, wherein the method comprises supporting the line to hang from a carriage mounted to an outrigger platform that is movable along the hull of the vessel, the hang off carriage being moveable on or relative to the platform and movable in two horizontal orthogonal axes by movement of the carriage on or relative to the platform and movement of the platform along the hull of the vessel such that the carriage is movable around a horizontal area located beneath deployment locations on the vessel spaced horizontally from each other, and moving the carriage to bring the line into alignment with a deployment location for connection of subsequent sections of the line.

* * * * *